US009957596B2

(12) United States Patent
Na et al.

(10) Patent No.: US 9,957,596 B2
(45) **Date of Patent: *May 1, 2018**

(54) BULK NICKEL-IRON-BASED, NICKEL-COBALT-BASED AND NICKEL-COPPER BASED GLASSES BEARING CHROMIUM, NIOBIUM, PHOSPHORUS AND BORON

(71) Applicants: Glassimetal Technology, Inc., Pasadena, CA (US); Apple Inc., Cupertino, CA (US)

(72) Inventors: Jong Hyun Na, Pasadena, CA (US); Chase Crewdson, Los Angeles, CA (US); Oscar Abarca, Anaheim, CA (US); Danielle Duggins, Garden Grove, CA (US); Maximilien Launey, Pasadena, CA (US); Marios D. Demetriou, West Hollywood, CA (US); William L. Johnson, San Marino, CA (US)

(73) Assignees: Glassimetal Technology, Inc., Pasadena, CA (US); Apple Inc., Cupertino, CA (US)

( * ) Notice: Subject to any disclaimer, the term of this patent is extended or adjusted under 35 U.S.C. 154(b) by 516 days.

This patent is subject to a terminal disclaimer.

(21) Appl. No.: 14/581,950

(22) Filed: Dec. 23, 2014

(65) Prior Publication Data

US 2015/0176111 A1 Jun. 25, 2015

Related U.S. Application Data

(60) Provisional application No. 61/920,362, filed on Dec. 23, 2013.

(51) Int. Cl.
*C22C 45/04* (2006.01)
*C22C 1/00* (2006.01)

(52) U.S. Cl.
CPC ..... *C22C 45/04* (2013.01); *C22C 1/002* (2013.01)

(58) Field of Classification Search
None
See application file for complete search history.

(56) References Cited

U.S. PATENT DOCUMENTS 3,856,513 A 12/1974 Chen et al.
4,116,682 A 9/1978 Polk et al.
(Continued)

FOREIGN PATENT DOCUMENTS

CN 1354274 6/2002
CN 1653200 8/2005
(Continued)

OTHER PUBLICATIONS

Habazaki et al., "Preparation of corrosion-resistant amorphous Ni—Cr—P—B bulk alloys containing molybdenum and tantalum," *Material Science and Engineering*, A304-306, 2001, pp. 696-700.
(Continued)

*Primary Examiner* — George Wyszomierski
(74) *Attorney, Agent, or Firm* — Polsinelli PC

(57) ABSTRACT

Ni—Fe, Ni—Co, and Ni—Cu-based bulk metallic glass forming alloys are provided. The alloys have critical rod diameters of at least 1 mm and in some instances at least 11 mm. The alloys have composition according to $Ni_{(100-a-b-c-d-e)}X_aCr_bNb_cP_dB_e$, wherein X is at least one of Fe, Co, and Cu, the atomic percent X (Fe and/or Co and/or Cu) ranges from 0.5 to 30, the atomic percent of Cr ranges from 2 to 15, the atomic percent of Nb ranges from 1 to 5, the atomic percent of P ranges from 14 to 19, the atomic percent of B ranges from 1 to 5, and the balance is Ni.

16 Claims, 30 Drawing Sheets

(56) References Cited

U.S. PATENT DOCUMENTS

| | | | | |
|---|---|---|---|---|
| 4,126,284 | A | 11/1978 | Ichikawa et al. | |
| 4,144,058 | A | 3/1979 | Chen et al. | |
| 4,152,144 | A | 5/1979 | Hasegawa et al. | |
| 4,385,932 | A | 5/1983 | Inomata et al. | |
| 4,385,944 | A | 5/1983 | Hasegawa | |
| 4,582,536 | A | 4/1986 | Raybould | |
| 4,892,628 | A | 1/1990 | Guilinger | |
| 4,900,638 | A | 2/1990 | Emmerich | |
| 4,968,363 | A | 11/1990 | Hashimoto et al. | |
| 5,338,376 | A | 8/1994 | Liu et al. | |
| 5,429,725 | A | 7/1995 | Thorpe et al. | |
| 5,634,989 | A | 6/1997 | Hashimoto et al. | |
| 6,004,661 | A | 12/1999 | Sakai et al. | |
| 6,303,015 | B1 | 10/2001 | Thorpe et al. | |
| 6,325,868 | B1 | 12/2001 | Kim et al. | |
| 6,695,936 | B2 | 2/2004 | Johnson | |
| 8,052,923 | B2 | 11/2011 | Langlet | |
| 8,287,664 | B2 | 10/2012 | Brunner | |
| 9,085,814 | B2 * | 7/2015 | Na | C22C 1/002 |
| 2005/0263216 | A1 | 12/2005 | Chin et al. | |
| 2006/0213586 | A1 | 9/2006 | Kui | |
| 2007/0175545 | A1 | 8/2007 | Urata et al. | |
| 2009/0110955 | A1 | 4/2009 | Hartman et al. | |
| 2012/0073710 | A1 | 3/2012 | Kim et al. | |
| 2012/0168037 | A1 | 7/2012 | Demetriou et al. | |
| 2013/0048152 | A1 | 2/2013 | Na et al. | |
| 2013/0263973 | A1 | 10/2013 | Kurahashi et al. | |
| 2014/0076467 | A1 | 3/2014 | Na et al. | |
| 2014/0096873 | A1 | 4/2014 | Na et al. | |
| 2014/0116579 | A1 | 5/2014 | Na et al. | |
| 2014/0130942 | A1 | 5/2014 | Floyd et al. | |
| 2014/0130945 | A1 | 5/2014 | Na et al. | |
| 2014/0190593 | A1 | 7/2014 | Na et al. | |
| 2014/0213384 | A1 | 7/2014 | Johnson et al. | |
| 2014/0238551 | A1 | 8/2014 | Na et al. | |
| 2015/0047755 | A1 | 2/2015 | Na et al. | |
| 2015/0158126 | A1 | 6/2015 | Hartmann et al. | |
| 2015/0197837 | A9 * | 7/2015 | Schramm | C21D 1/40 148/511 |
| 2016/0060739 | A1 * | 3/2016 | Na | C22C 1/002 148/555 |

FOREIGN PATENT DOCUMENTS

| | | |
|---|---|---|
| DE | 3929222 | 3/1991 |
| DE | 102011001783 | 10/2012 |
| DE | 102011001784 | 10/2012 |
| EP | 0014335 | 8/1980 |
| EP | 0161393 | 11/1985 |
| EP | 0260706 | 3/1988 |
| EP | 1077272 | 2/2001 |
| EP | 1108796 | 6/2001 |
| EP | 1522602 | 4/2005 |
| JP | 54-76423 | 6/1979 |
| JP | S55-148752 | 11/1980 |
| JP | S57-13146 | 1/1982 |
| JP | 63-079930 | 4/1988 |
| JP | 63-079931 | 4/1988 |
| JP | 63-277734 | 11/1988 |
| JP | 1-205062 | 8/1989 |
| JP | 08-269647 | 10/1996 |
| JP | 11-71659 | 3/1999 |
| JP | 2001-049407 | 2/2001 |
| JP | 2007-075867 | 3/2007 |
| WO | WO 2012/053570 | 4/2012 |
| WO | WO 2013/028790 | 2/2013 |

OTHER PUBLICATIONS

Zhang et al., "The Corrosion Behavior of Amorphous Ni—Cr—P Alloys in Concentrated Hydrofluoric Acid," *Corrosion Science*, vol. 33, No. 10, pp. 1519-1528, 1992.

Katagiri et al., "An attempt at preparation of corrosion-resistant bulk amorphous Ni—Cr—Ta—Mo—P—B alloys," *Corrosion Science*, vol. 43, No. 1, pp. 183-191, 2001.

Habazaki et al., "Corrosion behaviour of amorphous Ni—Cr—Nb—P—B bulk alloys in 6M HCl solution," *Material Science and Engineering*, A318, 2001, pp. 77-86.

Murakami (Editor), *Stress Intensity Factors Handbook*, vol. 2, Oxford: Pergamon Press, 1987, 4 pages.

Yokoyama et al., "Viscous Flow Workability of Ni—Cr—P—B Metallic Glasses Produced by Melt-Spinning in Air," *Materials Transactions*, vol. 48, No. 12, 2007, pp. 3176-3180.

Park T.G. et al., "Development of new Ni-based amorphous alloys containing no metalloid that have large undercooled liquid regions," *Scripta Materialia*, vol. 43, No. 2, 2000, pp. 109-114.

Mitsuhashi A. et al., "The corrosion behavior of amorphous nickel base alloys in a hot concentrated phosphoric acid," *Corrosion Science*, vol. 27, No. 9, 1987, pp. 957-970.

Kawashima A. et al., "Change in corrosion behavior of amorphous Ni—P alloys by alloying with chromium, molybdenum or tungsten," *Journal of Non-Crystalline Solids*, vol. 70, No. 1, 1985, pp. 69-83.

Abrosimova G. E. et al., "Phase segregation and crystallization in the amorphous alloy $Ni_{70}Mo_{10}P_{20}$," *Physics of the Solid State*, vol. 40., No. 9, 1998, pp. 1429-1432.

Yokoyama M. et al., "Hot-press workability of Ni-based glassy alloys in supercooled liquid state and production of the glassy alloy separators for proton exchange membrane fuel cell," *Journal of the Japan Society of Powder and Powder Metallurgy*, vol. 54, No. 11, 2007, pp. 773-777.

Rabinkin et al., "Brazing Stainless Steel Using New MBF-Series of Ni—Cr—B—Si Amorphous Brazing Foils: New Brazing Alloys Withstand High-Temperature and Corrosive Environments," *Welding Research Supplement*, 1998, pp. 66-75.

Chen S.J. et al., "Transient liquid-phase bonding of T91 steel pipes using amorphous foil," *Materials Science and Engineering A*, vol. 499, No. 1-2, 2009, pp. 114-117.

Hartmann, Thomas et al., "New Amorphous Brazing Foils for Exhaust Gas Application," *Proceedings of the 4th International Brazing and Soldering Conference*, Apr. 26-29, 2009, Orlando, Florida, USA.

U.S. Appl. No. 14/501,779, filed Sep. 30, 2014, Na et al.

U.S. Appl. No. 14/540,815, filed Nov. 13, 2014, Na et al.

U.S. Appl. No. 14/565,219, filed Dec. 9, 2013, Na et al.

U.S. Appl. No. 14/824,733, filed Aug. 12, 2015, Na et al.

U.S. Appl. No. 14/797,878, filed Jul. 13, 2015, Na et al.

* cited by examiner

BULK NICKEL-IRON-BASED, NICKEL-COBALT-BASED AND NICKEL-COPPER BASED GLASSES BEARING CHROMIUM, NIOBIUM, PHOSPHORUS AND BORON

CROSS-REFERENCE TO RELATED APPLICATIONS

The present application claims the benefit of U.S. Provisional Patent Application No. 61/920,362, entitled "Bulk Nickel-Cobalt-Based Glasses Bearing Chromium, Niobium, Phosphorus and Boron", filed on Dec. 23, 2013, which is incorporated herein by reference in its entirety.

TECHNICAL FIELD

The disclosure relates to Ni—Fe—Cr—Nb—P—B, Ni—Co—Cr—Nb—P—B and Ni—Cu—Cr—NB—P—B alloys capable of forming metallic glass rods with critical rod diameters of at least 1 mm and as large as 9 mm or larger, and high thermal stability of the supercooled liquid.

BACKGROUND

Ni—Cr—Nb—P—B alloys demonstrating a critical rod diameter of 3 mm or larger have been disclosed in U.S. patent application Ser. No. 13/592,095, entitled "Bulk Nickel-Based Chromium and Phosphorus Bearing Metallic Glasses", filed on Aug. 22, 2012, Ser. No. 14/067,521, entitled "Bulk Nickel-Based Chromium and Phosphorus Bearing Metallic Glasses with High Toughness", filed on Oct. 30, 2013, and Ser. No. 14/540,815, entitled "Bulk Nickel-Chrome-Phosphorus Glasses Bearing Niobium and Boron Exhibiting High Strength and/or Thermal Stability of the Supercooled Liquid", filed on Nov. 13, 2014, the disclosures of which are incorporated herein by reference in their entirety. In these applications, peaks in glass forming ability are identified at a chromium (Cr) content ranging from 5 to 10 atomic percent, a niobium (Nb) content ranging from 3 to 3.5 atomic percent, a boron (B) content of about 3 atomic percent, and a phosphorus (P) content of about 16.5 atomic percent. Bulk metallic glass rods with diameters as large as 11 mm can be formed within those ranges.

Although both applications state that the substitution of Ni or Cr by Fe, Co, or Cu of up to 2 atomic percent may not impair the glass forming ability of the disclosed alloys, neither application addresses the potential of glass formation in the Ni—Fe—Cr—Nb—P—B, where Fe concentrations of up to 15 atomic percent are included or glass formation in the Ni—Co—Cr—Nb—P—B, where Co concentrations of up to 30 atomic percent are included.

BRIEF SUMMARY

In one embodiment, the disclosure provides an alloy or a metallic glass formed from the alloy represented by the following formula (subscripts denote atomic percent):

$$Ni_{(100-a-b-c-d-e)}X_aCr_bNb_cP_dB_e \quad \text{Eq. (1)}$$

where:
X is at least one of Fe, Co, and Cu
a ranges from 0.5 to 30
b ranges from 2 to 15
c ranges from 1 to 5
d ranges from 14 to 19
e ranges from 1 to 5.

In some aspects, the alloy has a critical rod diameter of at least 1 mm.

In one embodiment, X is Fe. Various Ni—Fe—Cr—Nb—P—B alloys and metallic glasses are disclosed, where Fe is included in concentrations of up to 15 atomic percent. The alloys demonstrate critical rod diameters of at least 3 mm in diameter and up to 9 mm or larger. The alloys may also exhibit thermal stability of the supercooled liquid as large as 60° C. or larger.

In one embodiment, the disclosure provides an alloy or a metallic glass formed of an alloy represented by the following formula (subscripts denote atomic percent):

$$Ni_{(100-a-b-c-d-e)}Fe_aCr_bNb_cP_dB_e \quad \text{Eq. (2)}$$

where:
a ranges from 0.5 to 15
b ranges from 2 to 15
c ranges from 1 to 5
d ranges from 14 to 19
e ranges from 1 to 5.

In some aspects, the alloy has a critical rod diameter of at least 1 mm.

In another embodiment, the alloy is capable of forming a bulk metallic glass object having a lateral dimension of at least 1 mm.

In another embodiment, a ranges from 0.5 to 10. In some aspects, the alloy has a critical rod diameter of at least 5 mm.

In another embodiment, a is greater than 2 and up to 15.

In another embodiment, a is greater than 4 and up to 15.

In another embodiment, a ranges from 0.5 to 12.5, b ranges from 5 to 12, c ranges from 2 to 4, d ranges from 16.25 to 17, and e ranges from 2.75 to 3.5. In some aspects, the alloy has a critical rod diameter of at least 2 mm.

In another embodiment, a ranges from 0.5 to 12.5, b ranges from 3 to 13, c is determined by x−y·b, where x ranges from 3.8 to 4.2 and y ranges from 0.11 to 0.14, d ranges from 16.25 to 17, e ranges from 2.75 to 3.5. In some aspects, the alloy has a critical rod diameter of at least 3 mm.

In another embodiment, a ranges from 0.5 to 10, b ranges from 7 to 11, c ranges from 2.75 to 3.25, d ranges from 16.25 to 16.75, and e ranges from 2.75 to 3.25. In some aspects, the alloy has a critical rod diameter of at least 5 mm.

In another embodiment, a ranges from 0.5 to 10, b ranges from 4 to 7, c ranges from 3.25 to 3.75, d ranges from 16.25 to 16.75, and e ranges from 2.75 to 3.25. In some aspects, the alloy has a critical rod diameter of at least 5 mm.

In another embodiment, a ranges from 0.5 to 5, b ranges from 7.5 to 9.5, c ranges from 2.75 to 3.25, d ranges from 16.25 to 16.75, and e ranges from 2.75 to 3.25. In some aspects, the alloy has a critical rod diameter of at least at least 7 mm.

In another embodiment, a ranges from 0.5 to 3, b ranges from 5 to 6, c ranges from 3.25 to 3.75, d ranges from 16.25 to 16.75, and e ranges from 2.75 to 3.25. In some aspects, the alloy has a critical rod diameter of at least 7 mm.

In another embodiment, a ranges from 0.5 to 7.5, b ranges from 7 to 11, c ranges from 2.5 to 3.5, d ranges from 16 to 17, e ranges from 2.5 to 3.5, and wherein the metallic glass has notch toughness, defined as the stress intensity factor at crack initiation when measured on a 3 mm diameter rod containing a notch with length ranging from 1 to 2 mm and root radius ranging from 0.1 to 0.15 mm, of at least 75 MPa $m^{1/2}$.

In another embodiment, a ranges from 0.5 to 5, b ranges from 4 to 7, c ranges from 3 to 4, d ranges from 16 to 17, e ranges from 2.5 to 3.5, and wherein the metallic glass has notch toughness, defined as the stress intensity factor at crack initiation when measured on a 3 mm diameter rod containing a notch with length ranging from 1 to 2 mm and root radius ranging from 0.1 to 0.15 mm, of at least 85 MPa $m^{1/2}$.

In another embodiment, the metallic glass has a difference between the crystallization temperature $T_x$ and the glass transition temperature $T_g$, $\Delta T_x = T_x - T_g$, measured at heating rate of 20 K/min, of at least 41° C.

In another embodiment, the metallic glass has a difference between the crystallization temperature $T_x$ and the glass transition temperature $T_g$, $\Delta T_x = T_x - T_g$, measured at heating rate of 20 K/min, of at least 46° C.

In another embodiment, the metallic glass has a difference between the crystallization temperature $T_x$ and the glass transition temperature $T_g$, $\Delta T_x = T_x - T_g$, measured at heating rate of 20 K/min, of at least 50° C.

In another embodiment, the metallic glass has a difference between the crystallization temperature $T_x$ and the glass transition temperature $T_g$, $\Delta T_x = T_x - T_g$, measured at heating rate of 20 K/min, of at least 55° C.

In another embodiment, a ranges from 0.5 to 15, b ranges from 7 to 11, c ranges from 2 to 4, d ranges from 15.5 to 17.5, e ranges from 2 to 4, and wherein the metallic glass has a difference between the crystallization temperature $T_x$ and the glass transition temperature $T_g$, $\Delta T_x = T_x - T_g$, measured at heating rate of 20 K/min, of at least 46° C.

In another embodiment, a ranges from 0.5 to 10, b ranges from 7 to 11, c ranges from 2.5 to 3.5, d ranges from 16 to 17, e ranges from 2.5 to 3.5, and wherein the metallic glass has a difference between the crystallization temperature $T_x$ and the glass transition temperature $T_g$, $\Delta T_x = T_x - T_g$, measured at heating rate of 20 K/min, is at least 50° C.

In another embodiment, a ranges from 0.5 to 12.5, b ranges from 3 to 13, c is determined by x−y·b, where x ranges from 3.8 to 4.2 and y ranges from 0.11 to 0.14, d ranges from 15.5 to 17.5, e ranges from 2 to 4, and wherein the metallic glass has a difference between the crystallization temperature $T_x$ and the glass transition temperature $T_g$, $\Delta T_x = T_x - T_g$, measured at heating rate of 20 K/min, of at least 41° C.

In another embodiment, a ranges from 0.5 to 10, b ranges from 4 to 7, c ranges from 3.5 to 3.5, d ranges from 16 to 17, e ranges from 2.5 to 3.5, and wherein the metallic glass has a difference between the crystallization temperature $T_x$ and the glass transition temperature $T_g$, $\Delta T_x = T_x - T_g$, measured at heating rate of 20 K/min, of at least 50° C.

In yet another embodiment, up to 2 atomic percent of Fe is substituted by Co, Mn, W, Mo, Ru, Re, Cu, Pd, Pt, or combinations thereof.

In yet another embodiment, up to 2 atomic percent of Ni is substituted by Co, Mn, W, Mo, Ru, Re, Cu, Pd, Pt, or combinations thereof.

In yet another embodiment, up to 1.5 atomic percent of Nb is substituted by Ta, V, or combinations thereof.

In yet another embodiment, up to 1 atomic percent of P is substituted by Si.

In yet another embodiment, the melt of the alloy is fluxed with a reducing agent prior to rapid quenching.

In yet another embodiment, the reducing agent is boron oxide.

In yet another embodiment, the temperature of the melt prior to quenching is at least 100° C. above the liquidus temperature of the alloy.

In yet another embodiment, the temperature of the melt prior to quenching is at least 1100° C.

The disclosure is also directed to an alloy or a metallic glass having compositions selected from a group consisting of: $Ni_{67.5}Fe_{1.5}Cr_{8.5}Nb_3P_{16.5}B_3$, $Ni_{66}Fe_3Cr_{8.5}Nb_3P_{16.5}B_3$, $Ni_{64}Fe_5Cr_{8.5}Nb_3P_{16.5}B_3$, $Ni_{61.5}Fe_{7.5}Cr_{8.5}Nb_3P_{16.5}B_3$, $Ni_{59}Fe_{10}Cr_{8.5}Nb_3P_{16.5}B_3$, $Ni_{56.5}Fe_{12.5}Cr_{8.5}Nb_3P_{16.5}B_3$, $Ni_{54}Fe_{15}Cr_{8.5}Nb_3P_{16.5}B_3$, $Ni_{69.9}Fe_{1.5}Cr_{5.52}Nb_{3.38}P_{16.67}B_{3.03}$, $Ni_{68.4}Fe_3Cr_{5.52}Nb_{3.38}P_{16.67}B_{3.03}$, $Ni_{66.4}Fe_5Cr_{5.52}Nb_{3.38}P_{16.67}B_{3.03}$, $Ni_{53.9}Fe_{7.5}Cr_{5.52}Nb_{3.38}P_{16.67}B_{3.03}$, $Ni_{61.4}Fe_{10}Cr_{5.52}Nb_{3.38}P_{16.67}B_{3.03}$, $Ni_{58.9}Fe_{12.5}Cr_{5.52}Nb_{3.38}P_{16.67}B_{3.03}$, and $Ni_{56.4}Fe_{15}Cr_{5.52}Nb_{3.38}P_{16.67}B_{3.03}$.

In a further embodiment, a method is provided for forming a metallic glass object having a lateral dimension of at least 3 mm. The method includes melting an alloy into a molten state, the alloy comprising at least Ni, Fe, Cr, Nb, P, and B with a formula $Ni_{(100-a-b-c-d-e)}Fe_aCr_bNb_cP_dB_e$, wherein an atomic percent of iron (Fe) a ranges from 0.5 to 15, wherein an atomic percent of chromium (Cr) b ranges from 2 to 15, an atomic percent of niobium (Nb) c ranges from 1 to 5, an atomic percent of phosphorus (P) d ranges from 14 to 19, an atomic percent of boron (B) e ranges from 1 to 5, and the balance is nickel (Ni). The method also includes quenching the molten alloy at a cooling rate sufficiently rapid to prevent crystallization of the alloy.

In another embodiment, X is Co. The disclosure provides Ni—Co—Cr—Nb—P—B alloys and metallic glasses, where Co is included in concentrations of up to 30 atomic percent. The alloys have critical rod diameters of at least 3 mm in diameter and up to 11 mm or larger. The alloys may also exhibit notch toughness values in excess of 100 MPa $m^{1/2}$.

In one embodiment, the disclosure provides an alloy or a metallic glass formed of an alloy represented by the following formula (subscripts denote atomic percent):

$$Ni_{(100-a-b-c-d-e)}Co_aCr_bNb_cP_dB_e \quad \text{Eq. (3)}$$

where:

a ranges from 0.5 to 30
b ranges from 2 to 15
c ranges from 1 to 5
d ranges from 14 to 19
e ranges from 1 to 5.

In some aspect, the alloy has a critical rod diameter of at least 3 mm.

In another embodiment, a is greater than 2 and up to 30.

In another embodiment, a is greater than 4 and up to 30.

In another embodiment, a ranges from 0.5 to 20, b ranges from 5 to 12, c ranges from 2 to 4, d ranges from 16.25 to 17, and e ranges from 2.75 to 3.5. In some aspects, the alloy has a critical rod diameter of at least 6 mm.

In another embodiment, a ranges from 0.5 to 20, b ranges from 3 to 13, c is determined by x−y·b, where x ranges from 3.8 to 4.2 and y ranges from 0.11 to 0.14, d ranges from 16.25 to 17, e ranges from 2.75 to 3.5. In some aspects, the alloy has a critical rod diameter of at least 6 mm.

In another embodiment, a ranges from 0.5 to 15, b ranges from 7.5 to 11, c ranges from 2.75 to 3.25, d ranges from 16.25 to 16.75, e ranges from 2.75 to 3.25, and wherein the alloy has a critical rod diameter of at least 8 mm.

In another embodiment, a ranges from 0.5 to 15, b ranges from 4 to 7.5, c ranges from 3.25 to 3.75, d ranges from 16.25 to 16.75, e ranges from 2.75 to 3.25, and wherein the alloy has a critical rod diameter of at least 8 mm.

In another embodiment, a ranges from 0.5 to 10, b ranges from 8 to 9.5, c ranges from 2.75 to 3.25, d ranges from 16.25 to 16.75, e ranges from 2.75 to 3.25, and wherein the alloy has a critical rod diameter of at least at least 9 mm.

In another embodiment, a ranges from 0.5 to 10, b ranges from 5 to 6, c ranges from 3.25 to 3.75, d ranges from 16.25 to 16.75, e ranges from 2.75 to 3.25, and wherein the alloy has a critical rod diameter of at least 9 mm.

In another embodiment, a ranges from 0.5 to 5, b ranges from 8 to 9.5, c ranges from 2.75 to 3.25, d ranges from 16.25 to 16.75, e ranges from 2.75 to 3.25, and wherein the alloy has a critical rod diameter of at least 9 mm, and wherein the notch toughness of the metallic glass, defined as the stress intensity factor at crack initiation when measured on a 3 mm diameter rod containing a notch with length ranging from 1 to 2 mm and root radius ranging from 0.1 to 0.15 mm, is at least 70 MPa m1/2.

In another embodiment, a ranges from 0.5 to 5, b ranges from 5 to 6, c ranges from 3.25 to 3.75, d ranges from 16.25 to 16.75, e ranges from 2.75 to 3.25, and wherein the alloy has a critical rod diameter of at least 9 mm, and wherein the notch toughness of the metallic glass, defined as the stress intensity factor at crack initiation when measured on a 3 mm diameter rod containing a notch with length ranging from 1 to 2 mm and root radius ranging from 0.1 to 0.15 mm, is at least 80 MPa $m^{1/2}$.

In another embodiment, a ranges from 0.5 to 3, b ranges from 8 to 9.5, c ranges from 2.75 to 3.25, d ranges from 16.25 to 16.75, e ranges from 2.75 to 3.25, and wherein the alloy has a critical rod diameter of at least 10 mm, and wherein the notch toughness of the metallic glass, defined as the stress intensity factor at crack initiation when measured on a 3 mm diameter rod containing a notch with length ranging from 1 to 2 mm and root radius ranging from 0.1 to 0.15 mm, is at least 80 MPa $m^{1/2}$.

In another embodiment, a ranges from 0.5 to 3, b ranges from 5 to 6, c ranges from 3.25 to 3.75, d ranges from 16.25 to 16.75, e ranges from 2.75 to 3.25, and wherein the alloy has a critical rod diameter of at least 9 mm, and wherein the notch toughness of the metallic glass, defined as the stress intensity factor at crack initiation when measured on a 3 mm diameter rod containing a notch with length ranging from 1 to 2 mm and root radius ranging from 0.1 to 0.15 mm, is at least 94 MPa $m^{1/2}$.

In another embodiment, a ranges from 0.5 to 25, b ranges from 8 to 9.5, c ranges from 2.75 to 3.25, d ranges from 16.25 to 16.75, e ranges from 2.75 to 3.25, and wherein the metallic glass has a difference between the crystallization temperature $T_x$ and the glass transition temperature $T_g$, $\Delta T_x = T_x - T_g$, measured at heating rate of 20 K/min, of at least 46° C.

In another embodiment, a ranges from 0.5 to 25, b ranges from 5 to 6, c ranges from 3.25 to 3.75, d ranges from 16.25 to 16.75, e ranges from 2.75 to 3.25, and wherein the metallic glass has a difference between the crystallization temperature $T_x$ and the glass transition temperature $T_g$, $\Delta T_x = T_x - T_g$, measured at heating rate of 20 K/min, of at least 41° C.

In another embodiment, a is greater than 4 and up to 25, b ranges from 8 to 9.5, c ranges from 2.75 to 3.25, d ranges from 16.25 to 16.75, e ranges from 2.75 to 3.25, and wherein the metallic glass has a difference between the crystallization temperature $T_x$ and the glass transition temperature $T_g$, $\Delta T_x = T_x - T_g$, measured at heating rate of 20 K/min, of at least 50° C.

In another embodiment, a is greater than 4 and up to 25, b ranges from 5 to 6, c ranges from 3.25 to 3.75, d ranges from 16.25 to 16.75, e ranges from 2.75 to 3.25, and wherein the metallic glass has a difference between the crystallization temperature $T_x$ and the glass transition temperature $T_g$, $\Delta T_x = T_x - T_g$, measured at heating rate of 20 K/min, of at least 44° C.

In yet another embodiment, up to 2 atomic percent of Cr is substituted by Fe, Mn, W, Mo, Ru, Re, Cu, Pd, Pt, or combinations thereof.

In yet another embodiment, up to 2 atomic percent of Ni is substituted by Fe, Mn, W, Mo, Ru, Re, Cu, Pd, Pt, or combinations thereof.

In yet another embodiment, up to 1.5 atomic percent of Nb is substituted by Ta, V, or combinations thereof.

In yet another embodiment, the melt of the alloy is fluxed with a reducing agent prior to rapid quenching.

In yet another embodiment, the reducing agent comprises boron and oxygen.

In yet another embodiment, the reducing agent is boron oxide.

In yet another embodiment, the temperature of the melt prior to quenching is at least 100° C. above the liquidus temperature of the alloy.

The disclosure is also directed to an alloy or a metallic glass having compositions selected from a group consisting of: $Ni_{67.5}Co_{1.5}Cr_{8.5}Nb_3P_{16.5}B_3$, $Ni_{66}Co_3Cr_{8.5}Nb_3P_{16.5}B_3$, $Ni_{64}Co_5Cr_{8.5}Nb_3P_{16.5}B_3$, $Ni_{59}Co_{10}Cr_{8.5}Nb_3P_{16.5}B_3$, $Ni_{54}Co_{15}Cr_{8.5}Nb_3P_{16.5}B_3$, $Ni_{49}Co_{20}Cr_{8.5}Nb_3P_{16.5}B_3$, $Ni_{44}Co_{25}Cr_{8.5}Nb_3P_{16.5}B_3$, $Ni_{39}Co_{30}Cr_{8.5}Nb_3P_{16.5}B_3$, $Ni_{69.9}Co_{1.5}Cr_{5.52}Nb_{3.38}P_{16.67}B_{3.03}$, $Ni_{68.4}Co_3Cr_{5.52}Nb_{3.38}P_{16.67}B_{3.03}$, $Ni_{66.4}Co_5Cr_{5.52}Nb_{3.38}P_{16.67}B_{3.03}$, $Ni_{61.4}Co_{10}Cr_{5.52}Nb_{3.38}P_{16.67}B_{3.03}$, $Ni_{56.4}Co_{15}Cr_{5.52}Nb_{3.38}P_{16.67}B_{3.03}$, $Ni_{51.4}Co_{20}Cr_{5.52}Nb_{3.38}P_{16.67}B_{3.03}$, $Ni_{46.4}Co_{25}Cr_{5.52}Nb_{3.38}P_{16.67}B_{3.03}$, and $Ni_{41.1}Co_{30}Cr_{5.52}Nb_{3.38}P_{16.67}B_{3.03}$.

In a further embodiment, a method is provided for forming a metallic glass object having a lateral dimension of at least 3 mm. The method includes melting an alloy into a molten state, the alloy comprising at least Ni, Co, Cr, Nb, P, and B with a formula $Ni_{(100-a-b-c-d-e)}Co_aCr_bNb_cP_dB_e$, wherein an atomic percent of cobalt (Co) a ranges from 0.5 to 30, wherein an atomic percent of chromium (Cr) a ranges from 2 to 15, an atomic percent of niobium (Nb) b ranges from 1 to 5, an atomic percent of phosphorus (P) c ranges from 14 to 19, an atomic percent of boron (B) d ranges from 1 to 5, and the balance is nickel (Ni). The method also includes quenching the molten alloy at a cooling rate sufficiently rapid to prevent crystallization of the alloy.

In another embodiment, X is Cu. The disclosure provides Ni—Cu—Cr—Nb—P—B alloys and metallic glasses, where Cu is included in concentrations of up to 10 atomic percent. The alloys demonstrate critical rod diameters of at least 1 mm in diameter and up to 9 mm or larger. The alloys may also exhibit thermal stability of the supercooled liquid as large as 55° C. or larger.

In one embodiment, the disclosure provides an alloy or a metallic glass formed of an alloy represented by the following formula (subscripts denote atomic percent):

$$Ni_{(100-a-b-c-d-e)}Cu_aCr_bNb_cP_dB_e \quad \text{Eq. (4)}$$

where:

a ranges from 0.5 to 10 b ranges from 2 to 15 c ranges from 1 to 5 d ranges from 14 to 19 e ranges from 1 to 5.

In some aspects, the alloy has a critical rod diameter of at least 1 mm.

In another embodiment, the alloy is capable of forming a bulk metallic glass object having a lateral dimension of at least 1 mm.

In another embodiment, a ranges from 0.5 to 5. In some aspects, the alloy has a critical rod diameter of at least 6 mm.

In another embodiment, a is greater than 2 and up to 10.

In another embodiment, a is greater than 4 and up to 10.

In another embodiment, a ranges from 0.5 to 7.5, b ranges from 5 to 12, c ranges from 2 to 4, d ranges from 16.25 to 17, e ranges from 2.75 to 3.5, and wherein the alloy has a critical rod diameter of at least 2 mm.

In another embodiment, a ranges from 0.5 to 7.5, b ranges from 3 to 13, c is determined by x−y·b, where x ranges from 3.8 to 4.2 and y ranges from 0.11 to 0.14, d ranges from 16.25 to 17, e ranges from 2.75 to 3.5, and wherein the alloy has a critical rod diameter of at least 3 mm.

In another embodiment, a ranges from 0.5 to 5, b ranges from 7 to 11, c ranges from 2.75 to 3.25, d ranges from 16.25 to 16.75, e ranges from 2.75 to 3.25, and wherein the alloy has a critical rod diameter of at least 5 mm.

In another embodiment, a ranges from 0.5 to 5, b ranges from 4 to 7, c ranges from 3.25 to 3.75, d ranges from 16.25 to 16.75, e ranges from 2.75 to 3.25, and wherein the alloy has a critical rod diameter of at least 7 mm.

In another embodiment, a ranges from 0.5 to 5, b ranges from 7.5 to 9.5, c ranges from 2.75 to 3.25, d ranges from 16.25 to 16.75, e ranges from 2.75 to 3.25, and wherein the alloy has a critical rod diameter of at least at least 6 mm.

In another embodiment, a ranges from 0.5 to 3, b ranges from 5 to 6, c ranges from 3.25 to 3.75, d ranges from 16.25 to 16.75, e ranges from 2.75 to 3.25, and wherein the alloy has a critical rod diameter of at least 8 mm.

In another embodiment, a ranges from 0.5 to 3, b ranges from 7 to 11, c ranges from 2.5 to 3.5, d ranges from 16 to 17, e ranges from 2.5 to 3.5, and wherein the notch toughness of the metallic glass, defined as the stress intensity factor at crack initiation when measured on a 3 mm diameter rod containing a notch with length ranging from 1 to 2 mm and root radius ranging from 0.1 to 0.15 mm, is at least 70 MPa $m^{1/2}$.

In another embodiment, a ranges from 0.5 to 5, b ranges from 4 to 7, c ranges from 3.5 to 3.5, d ranges from 16 to 17, e ranges from 2.5 to 3.5, and wherein the notch toughness of the metallic glass, defined as the stress intensity factor at crack initiation when measured on a 3 mm diameter rod containing a notch with length ranging from 1 to 2 mm and root radius ranging from 0.1 to 0.15 mm, is at least 45 MPa $m^{1/2}$.

In another embodiment, the metallic glass has a difference between the crystallization temperature $T_x$ and the glass transition temperature $T_g$, $\Delta T_x=T_x-T_g$, measured at heating rate of 20 K/min, of at least 41° C.

In another embodiment, the metallic glass has a difference between the crystallization temperature $T_x$ and the glass transition temperature $T_g$, $\Delta T_x=T_x-T_g$, measured at heating rate of 20 K/min, of at least 46° C.

In another embodiment, the metallic glass has a difference between the crystallization temperature $T_x$ and the glass transition temperature $T_g$, $\Delta T_x=T_x-T_g$, measured at heating rate of 20 K/min, of at least 50° C.

In another embodiment, the metallic glass has a difference between the crystallization temperature $T_x$ and the glass transition temperature $T_g$, $\Delta T_x=T_x-T_g$, measured at heating rate of 20 K/min, of at least 52.5° C.

In another embodiment, a ranges from 0.5 to 5, b ranges from 7 to 11, c ranges from 2 to 4, d ranges from 15.5 to 17.5, e ranges from 2 to 4, and wherein the metallic glass has a difference between the crystallization temperature $T_x$ and the glass transition temperature $T_g$, $\Delta T_x=T_x-T_g$, measured at heating rate of 20 K/min, of at least 46° C.

In another embodiment, a ranges from 0.5 to 3, b ranges from 7 to 11, c ranges from 2.5 to 3.5, d ranges from 16 to 17, e ranges from 2.5 to 3.5, and wherein the metallic glass has a difference between the crystallization temperature $T_x$ and the glass transition temperature $T_g$, $\Delta T_x=T_x-T_g$, measured at heating rate of 20 K/min, of at least 50° C.

In another embodiment, a ranges from 0.5 to 10, b ranges from 3 to 13, c is determined by x−y·b, where x ranges from 3.8 to 4.2 and y ranges from 0.11 to 0.14, d ranges from 15.5 to 17.5, e ranges from 2 to 4, and wherein the metallic glass has a difference between the crystallization temperature $T_x$ and the glass transition temperature $T_g$, $\Delta T_x=T_x-T_g$, measured at heating rate of 20 K/min, of at least 41° C.

In another embodiment, a ranges from 0.5 to 5, b ranges from 4 to 7, c ranges from 3.5 to 3.5, d ranges from 16 to 17, e ranges from 2.5 to 3.5, and wherein the metallic glass has a difference between the crystallization temperature $T_x$ and the glass transition temperature $T_g$, $\Delta T_x=T_x-T_g$, measured at heating rate of 20 K/min, of at least 50° C.

In yet another embodiment, up to 2 atomic percent of Cr is substituted by Co, Fe, Mn, W, Mo, Ru, Re, Pd, Pt, or combinations thereof.

In yet another embodiment, up to 2 atomic percent of Ni is substituted by Co, Fe, Mn, W, Mo, Ru, Re, Pd, Pt, or combinations thereof.

In yet another embodiment, up to 1.5 atomic percent of Nb is substituted by Ta, V, or combinations thereof.

In yet another embodiment, up to 1 atomic percent of P is substituted by Si.

In yet another embodiment, the melt of the alloy is fluxed with a reducing agent prior to rapid quenching.

In yet another embodiment, the reducing agent comprises boron and oxygen.

In yet another embodiment, the reducing agent is boron oxide.

In yet another embodiment, the temperature of the melt prior to quenching is at least 100° C. above the liquidus temperature of the alloy.

In yet another embodiment, the temperature of the melt prior to quenching is at least 1100° C.

The disclosure is also directed to an alloy or a metallic glass having compositions selected from a group consisting of: $Ni_{67.5}Cu_{1.5}Cr_{8.5}Nb_3P_{16.5}B_3$, $Ni_{66}Cu_3Cr_{8.5}Nb_3P_{16.5}B_3$, $Ni_{64}Cu_5Cr_{8.5}Nb_3P_{16.5}B_3$, $Ni_{59}Cu_{10}Cr_{8.5}Nb_3P_{16.5}B_3$, $Ni_{69.9}Cu^{1.5}Cr_{5.52}Nb_{3.38}P_{16.67}B_{3.03}$, $Ni_{68.4}Cu_3Cr_{5.52}Nb_{3.38}P_{16.67}B_{3.03}$, $Ni_{66.4}Cu_5Cr_{5.52}Nb_{3.38}P_{16.67}B_{3.03}$, and $Ni_{61.4}Cu_{10}Cr_{5.52}Nb_{3.38}P_{16.67}B_{3.03}$.

In a further embodiment, a method is provided for forming a metallic glass object having a lateral dimension of at least 3 mm. The method includes melting an alloy into a molten state, the alloy comprising at least Ni, Cu, Cr, Nb, P, and B with a formula $Ni_{(100-a-b-c-d-e)}Cu_aCr_bNb_cP_dB_e$, wherein an atomic percent of copper (Cu) a ranges from 0.5 to 10, wherein an atomic percent of chromium (Cr) b ranges from 2 to 15, an atomic percent of niobium (Nb) c ranges from 1 to 5, an atomic percent of phosphorus (P) d ranges from 14 to 19, an atomic percent of boron (B) e ranges from 1 to 5, and the balance is nickel (Ni). The method also includes quenching the molten alloy at a cooling rate sufficiently rapid to prevent crystallization of the alloy.

The disclosure is further directed to a metallic glass having any of the above formulas and/or formed of any of the foregoing alloys.

Additional embodiments and features are set forth in part in the description that follows, and in part will become apparent to those skilled in the art upon examination of the specification or may be learned by the practice of the disclosed subject matter. A further understanding of the nature and advantages of the present invention may be realized by reference to the remaining portions of the specification and the drawings, which forms a part of this disclosure.

BRIEF DESCRIPTION OF THE DRAWINGS

The description will be more fully understood with reference to the following figures and data graphs, which are presented as various embodiments of the disclosure and should not be construed as a complete recitation of the scope of the disclosure.

DETAILED DESCRIPTION

Figure 1:
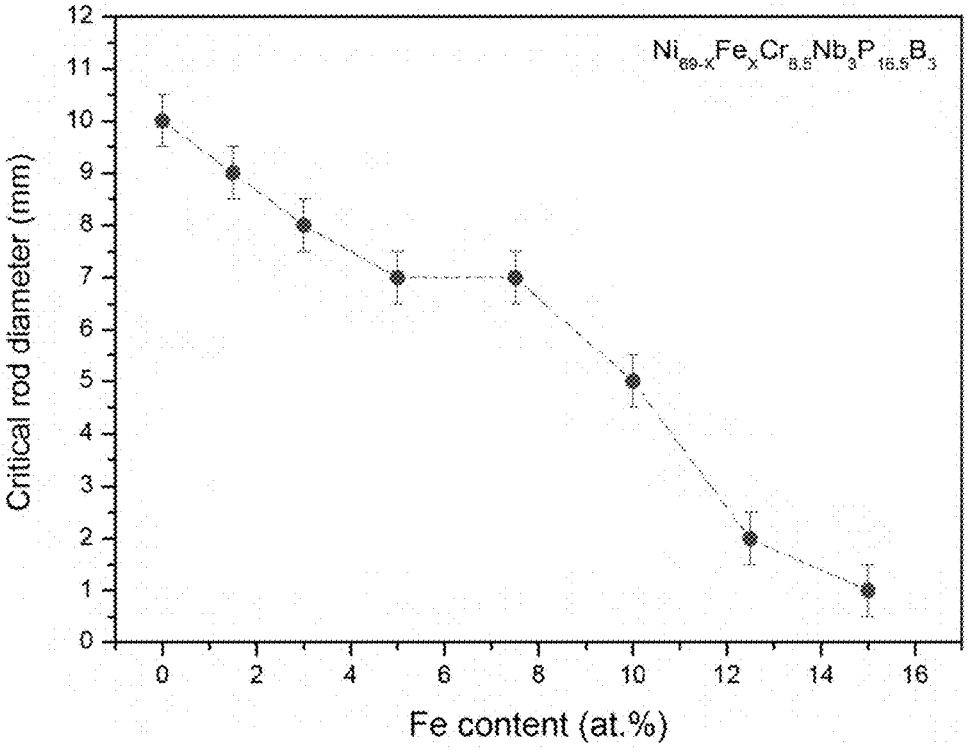
FIG. 1 provides a data plot showing the effect of varying the Ni and Fe atomic percent on the glass forming ability of $Ni_{69-x}Fe_xCr_{8.5}Nb_3P_{16.5}B_3$ alloys for $0 \le x \le 15$, in accordance with embodiments of the disclosure.

The disclosure is directed to alloys, metallic glasses, and methods of making and using the same. In some aspects, the alloys are described as capable of forming metallic glasses having certain characteristics. It is intended, and will be understood by those skilled in the art, that the disclosure is also directed to metallic glasses formed of the disclosed alloys described herein.

The disclosure provides Ni—Fe—Cr—Nb—P—B, Ni—Co—Cr—Nb—P—B and Ni—Cu—Cr—Nb—P—B based alloys and metallic glasses. The Ni—Fe—Cr—Nb—P—B alloys and metallic glasses include Fe in concentrations of up 15 atomic percent. The Ni—Co—Cr—Nb—P—B alloys and metallic glasses include Co in concentrations of up to 30 atomic percent. The Ni—Cu—Cr—Nb—P—B alloys and metallic glasses include Cu in concentrations of up to 10 atomic percent. The alloys demonstrate critical rod diameters of at least 1 mm and as large as 9 mm or larger. The alloys may also exhibit high thermal stability of the supercooled liquid.

Definitions

In the disclosure, the glass-forming ability of each alloy can be quantified by the "critical rod diameter," defined as the largest rod diameter in which the amorphous phase (i.e. the metallic glass) can be formed when processed by a method of water quenching a quartz tube having 0.5 mm thick walls containing a molten alloy.

A "critical cooling rate," which is defined as the cooling rate required to avoid crystallization and form the amorphous phase of the alloy (i.e. the metallic glass), determines the critical rod diameter. The lower the critical cooling rate of an alloy, the larger its critical rod diameter. The critical cooling rate $R_c$ in K/s and critical rod diameter $d_c$ in mm are related via the following approximate empirical formula:

$$R_c = 1000/d_c^2 \qquad \text{Eq. (5)}$$

According to Eq. (4), the critical cooling rate for an alloy having a critical rod diameter of about 3 mm, as in the case of the alloys according to embodiments of the disclosure, is only about $10^2$ K/s.

Generally, three categories are known in the art for identifying the ability of a metal alloy to form glass (i.e. to bypass the stable crystal phase and form an amorphous phase). Metal alloys having critical cooling rates in excess of $10^{12}$ K/s are typically referred to as non-glass formers, as it is physically impossible to achieve such cooling rates over a meaningful thickness. Metal alloys having critical cooling rates in the range of $10^5$ to $10^{12}$ K/s are typically referred to as marginal glass formers, as they are able to form glass over thicknesses ranging from 1 to 100 micrometers according to Eq. (5). Metal alloys having critical cooling rates on the order of $10^3$ or less, and as low as 1 or 0.1 K/s, are typically referred to as bulk glass formers, as they are able to form glass over thicknesses ranging from 1 millimeter to several centimeters. The glass-forming ability of a metallic alloy is, to a very large extent, dependent on the composition of the alloy. The compositional ranges for alloys capable of forming marginal glass formers are considerably broader than those for forming bulk glass formers.

The "notch toughness," is defined as the stress intensity factor at crack initiation $K_q$ when measured on a 3 mm diameter rod containing a notch with length ranging from 1 to 2 mm and root radius ranging from 0.1 to 0.15 mm. Notch toughness is the measure of the material's ability to resist fracture in the presence of a notch. The notch toughness is a measure of the work required to propagate a crack originating from a notch. A high $K_q$ corresponds to toughness of the material in the presence of defects.

The width of the supercooled region $\Delta T_x$ is defined as the difference between the crystallization temperature $T_x$ and the glass transition temperature $T_g$ of the metallic glass, $\Delta T_x = T_x - T_g$, measured at heating rate of 20 K/min. A large $\Delta T_x$ value implies a large thermal stability of the supercooled liquid and designates an ability of the metallic glass to be formed into an article by thermoplastic processing at temperatures above $T_g$.

The "compressive yield strength," $\sigma_y$, is the measure of the material's ability to resist non-elastic yielding. The yield strength is the stress at which the material yields plastically.

The plastic zone radius, $r_p$, defined as $K_q^2/\pi\sigma_y^2$, where $\sigma_y$ is the compressive yield strength, is a measure of the critical flaw size at which catastrophic fracture is occurs. The plastic zone radius determines the sensitivity of the material to flaws; a high $r_p$ designates a low sensitivity of the material to flaws.

Hardness is a measure of the material's ability to resist plastic indentation. A high hardness corresponds to resistance to indentation and scratching.

Bending ductility is a measure of the material's ability to deform plastically and resist fracture in bending in the absence of a notch or a pre-crack. A high bending ductility ensures that the material will be ductile in a bending overload.

Description of Alloy Compositions and Metallic glass Compositions

In accordance with the provided disclosure and drawings, Ni—Fe—Cr—Nb—P—B, Ni—Co—Cr—Nb—P—B, and Ni—Cu—Cr—Nb—P—B alloys are provided within well-defined compositional ranges requiring very low cooling rates to form metallic glass, thereby allowing for formation of bulk metallic glasses with critical rod diameters of at least 1 mm.

In some embodiments, Ni—Fe—Cr—Nb—P—B alloys that fall within the compositional range of the disclosure have a critical rod diameter of at least 1 mm can be represented by the following formula (subscripts denote atomic percent):

$$Ni_{(100-a-b-c-d-e)}Fe_aCr_bNb_cP_dB_e \qquad \text{Eq. (2)}$$

where: a ranges from 0.5 to 15, b ranges from 2 to 15, c ranges from 1 to 5, d ranges from 14 to 19, and e ranges from 1 to 5. In other embodiments, the atomic percent of Fe, a, ranges from greater than 2 to 15. In yet other embodiments, the atomic percent of Fe, a, ranges from greater than 4 to 15.

In other embodiments, Ni—Co—Cr—Nb—P—B alloys that fall within the compositional range of the disclosure have a critical rod diameter of at least 3 mm can be represented by the following formula (subscripts denote atomic percent):

$$Ni_{(100-a-b-c-d-e)}Co_aCr_bNb_cP_dB_e \quad \text{Eq. (3)}$$

where: a ranges from 0.5 to 30, b ranges from 2 to 15, c ranges from 1 to 5, d ranges from 14 to 19, and e ranges from 1 to 5. In other embodiments, the atomic percent of Co, a, ranges from greater than 2 to 30. In yet other embodiments, the atomic percent of Co, a, ranges from greater than 4 to 15.

In still other embodiments, Ni—Fe—Cr—Nb—P—B alloys that fall within the compositional range of the disclosure have a critical rod diameter of at least 1 mm can be represented by the following formula (subscripts denote atomic percent):

$$Ni_{(100-a-b-c-d-e)}Cu_aCr_bNb_cP_dB_e \quad \text{Eq. (4)}$$

where: a ranges from 0.5 to 10, b ranges from 2 to 15, c ranges from 1 to 5, d ranges from 14 to 19, and e ranges from 1 to 5. In other embodiments, the atomic percent of Cu, a, ranges from greater than 2 to 10. In yet other embodiments, the atomic percent of Cu, a, ranges from greater than 4 to 10

Ni—Fe—Cr—Nb—P—B Alloys and Metallic Glasses Compositions

In some embodiments, Ni—Fe—Cr—Nb—P—B alloys that fall within the compositional range of the disclosure have a critical rod diameter of at least 1 mm can be represented by the following formula (subscripts denote atomic percent):

$$Ni_{(100-a-b-c-d-e)}Fe_aCr_bNb_cP_dB_e \quad \text{Eq. (2)}$$

where: a ranges from 0.5 to 15, b ranges from 2 to 15, c ranges from 1 to 5, d ranges from 14 to 19, and e ranges from 1 to 5. In other embodiments, the atomic percent of Fe, a, ranges from greater than 2 to 15. In yet other embodiments, the atomic percent of Fe, a, ranges from greater than 4 to 15.

Specific embodiments of metallic glasses formed from alloys with compositions according to the formula $Ni_{69-x}Fe_xCr_{8.5}Nb_3P_{16.5}B_3$ are presented in Table 1. The critical rod diameters of sample alloys, along with the notch toughness of corresponding metallic glasses, are also listed in Table 1. Sample 1 with composition $Ni_{69}Cr_{8.5}Nb_3P_{16.5}B_3$ is free of Fe and is disclosed in U.S. patent application Ser. No. 13/592,095, exhibiting a critical rod diameter of 10 mm and a notch toughness of 77 MPa $m^{1/2}$.

TABLE 1

Sample amorphous alloys demonstrating the effect of increasing the Fe atomic concentration at the expense of Ni on the glass forming ability and notch toughness of the $Ni_{69}Cr_{8.5}Nb_3P_{16.5}B_3$ alloy and metallic glass, respectively.

| Sample | Composition | Critical Rod Diameter [mm] | Notch Toughness $K_Q$ (MPa $m^{1/2}$) |
|---|---|---|---|
| 1 | $Ni_{69}Cr_{8.5}Nb_3P_{16.5}B_3$ | 10 | 77.0 ± 6.1 |
| 2 | $Ni_{67.5}Fe_{1.5}Cr_{8.5}Nb_3P_{16.5}B_3$ | 9 | 79.6 ± 9.6 |
| 3 | $Ni_{66}Fe_3Cr_{8.5}Nb_3P_{16.5}B_3$ | 8 | 75.4 ± 4.3 |
| 4 | $Ni_{64}Fe_5Cr_{8.5}Nb_3P_{16.5}B_3$ | 7 | 85.2 ± 6.5 |
| 5 | $Ni_{61.5}Fe_{7.5}Cr_{8.5}Nb_3P_{16.5}B_3$ | 7 | 65.0 ± 3.0 |
| 6 | $Ni_{59}Fe_{10}Cr_{8.5}Nb_3P_{16.5}B_3$ | 5 | 40.9 ± 1.0 |
| 7 | $Ni_{56.5}Fe_{12.5}Cr_{8.5}Nb_3P_{16.5}B_3$ | 2 | — |
| 8 | $Ni_{54}Fe_{15}Cr_{8.5}Nb_3P_{16.5}B_3$ | 1 | — |

Figure 2:
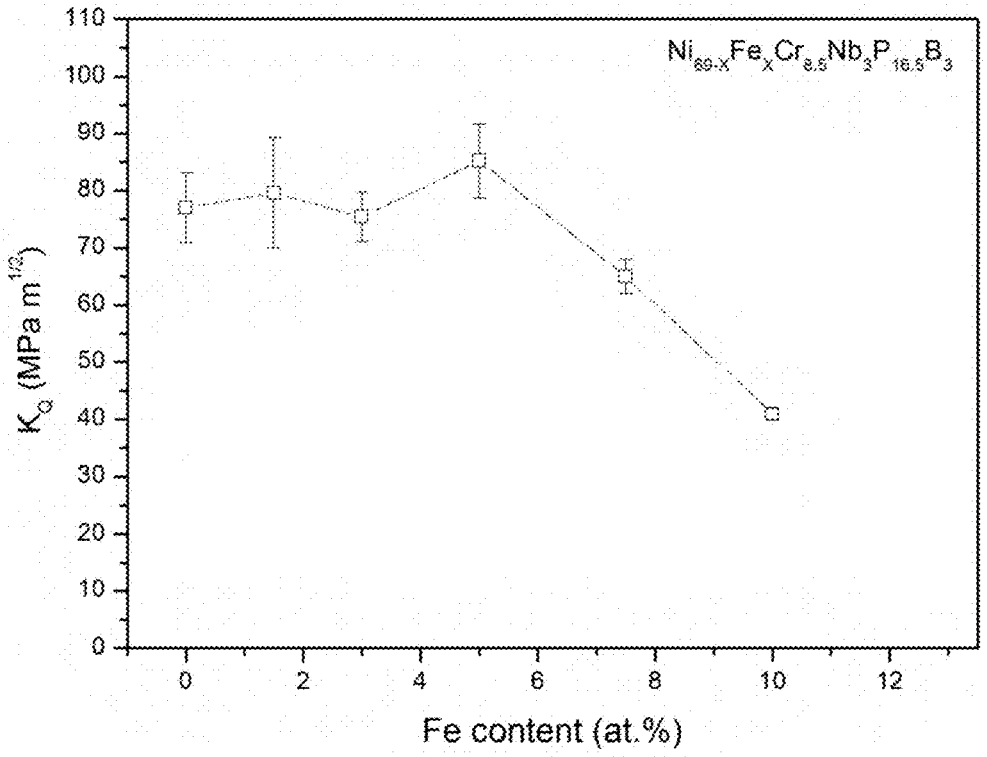
FIG. 2 provides a data plot showing the effect of varying the Ni and Fe atomic percent on the notch toughness of $Ni_{69-x}Fe_xCr_{8.5}Nb_3P_{16.5}B_3$ metallic glasses for $0 \le x \le 15$, in accordance with embodiments of the disclosure.

FIG. 1 provides a data plot showing the effect of varying the Ni and Fe atomic percent x on the glass forming ability of alloys according to the composition formula $Ni_{69-x}Fe_xCr_{8.5}Nb_3P_{16.5}B_3$. FIG. 2 provides a data plot showing the effect of varying the Ni and Fe atomic percent x on the notch toughness of metallic glasses according to the composition formula $Ni_{69-x}Fe_xCr_{8.5}Nb_3P_{16.5}B_3$. As shown in Table 1 and FIG. 1, alloys that satisfy the disclosed compositional range given by Eq. (2) demonstrate a critical rod diameter of at least 1 mm, and as high as 9 mm. Also, as shown in Table 1 and FIG. 2, alloys that satisfy the disclosed compositional range given by Eq. (2) demonstrate a notch of at least 40 MPa $m^{1/2}$, and as high as 85 MPa $m^{1/2}$. Specifically, Sample alloys 2-4 demonstrate a critical rod diameter of at least 7 mm and a notch toughness of at least 75 MPa $m^{1/2}$.

Therefore, in some embodiments, Ni—Fe—Cr—Nb—P—B alloys according to the disclosure where the atomic percent a ranges from 0.5 to 7.5, b ranges from 7 to 11, c ranges from 2.5 to 3.5, d ranges from 16 to 17, and e ranges from 2.5 to 3.5 demonstrate a critical rod diameter of at least 7 mm, and the notch toughness of the metallic glass is at least 75 MPa $m^{1/2}$.

Specific embodiments of metallic glasses formed from alloys with compositions according to the formula $Ni_{71.4-n-x}Fe_xCr_{5.52}Nb_{3.38}P_{16.67}13_{3.03}$ are presented in Table 2. The critical rod diameters of sample alloys, along with the notch toughness of corresponding metallic glasses, are also listed in Table 2. Sample 9 with composition $Ni_{71.4}Cr_{5.52}Nb_{3.38}P_{16.67}B_{3.03}$ is free of Fe and is disclosed in the previous U.S. Patent Application No. 61/720,015, exhibiting a critical rod diameter of 11 mm and a notch toughness of 94 MPa $m^{1/2}$.

TABLE 2

Sample amorphous alloys demonstrating the effect of increasing the Fe atomic concentration at the expense of Ni on the glass forming ability and notch toughness of the $Ni_{71.4}Cr_{5.52}Nb_{3.38}P_{16.67}B_{3.03}$ alloy and metallic glass, respectively.

| Sample | Composition | Critical Rod Diameter [mm] | Notch Toughness $K_Q$ (MPa $m^{1/2}$) |
|---|---|---|---|
| 9 | $Ni_{71.4}Cr_{5.52}Nb_{3.38}P_{16.67}B_{3.03}$ | 11 | 93.9 ± 2.0 |
| 10 | $Ni_{69.9}Fe_{1.5}Cr_{5.52}Nb_{3.38}P_{16.67}B_{3.03}$ | 9 | 90.4 ± 3.1 |
| 11 | $Ni_{68.4}Fe_3Cr_{5.52}Nb_{3.38}P_{16.67}B_{3.03}$ | 7 | 85.0 ± 4.8 |
| 12 | $Ni_{66.4}Fe_5Cr_{5.52}Nb_{3.38}P_{16.67}B_{3.03}$ | 5 | 37.2 ± 1.6 |
| 13 | $Ni_{53.9}Fe_{7.5}Cr_{5.52}Nb_{3.38}P_{16.67}B_{3.03}$ | 5 | 31.1 ± 2.0 |
| 14 | $Ni_{61.4}Fe_{10}Cr_{5.52}Nb_{3.38}P_{16.67}B_{3.03}$ | 5 | 36.4 ± 4.4 |
| 15 | $Ni_{58.9}Fe_{12.5}Cr_{5.52}Nb_{3.38}P_{16.67}B_{3.03}$ | 4 | 33.1 ± 3.8 |
| 16 | $Ni_{56.4}Fe_{15}Cr_{5.52}Nb_{3.38}P_{16.67}B_{3.03}$ | 1 | — |

Figure 3:
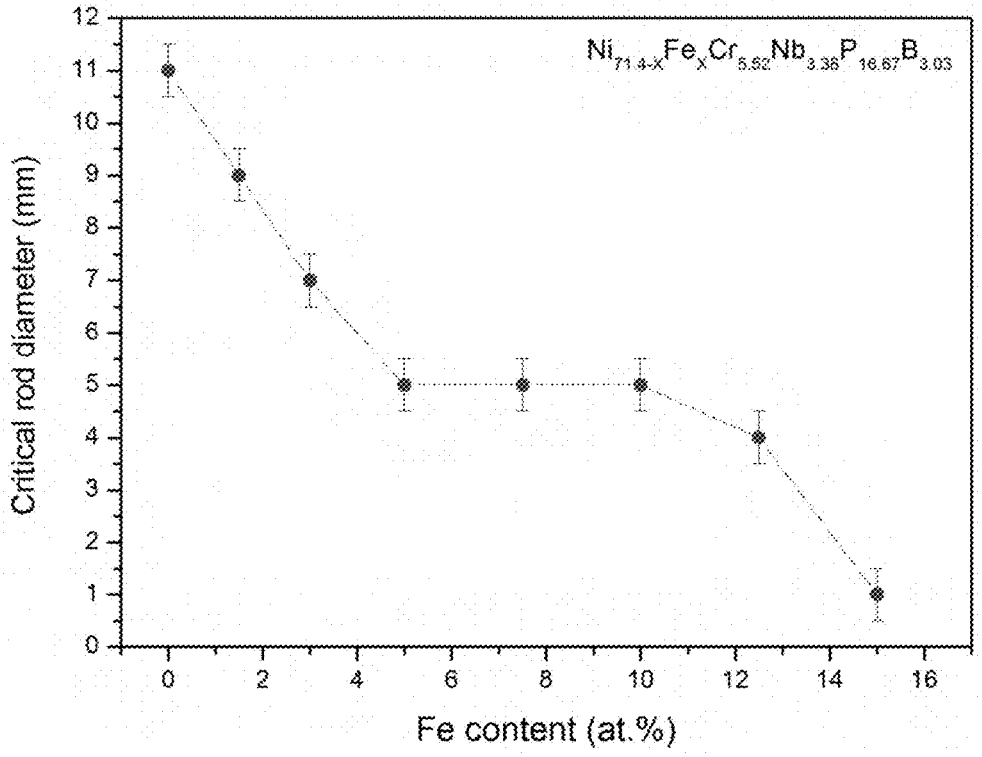
FIG. 3 provides a data plot showing the effect of varying the Ni and Fe atomic percent on the glass forming ability of $Ni_{71.4-x}Fe_xCr_{5.52}Nb_{3.38}P_{16.67}B_{3.03}$ alloys for $0 \le x \le 15$, in accordance with embodiments of the disclosure.
Figure 4:
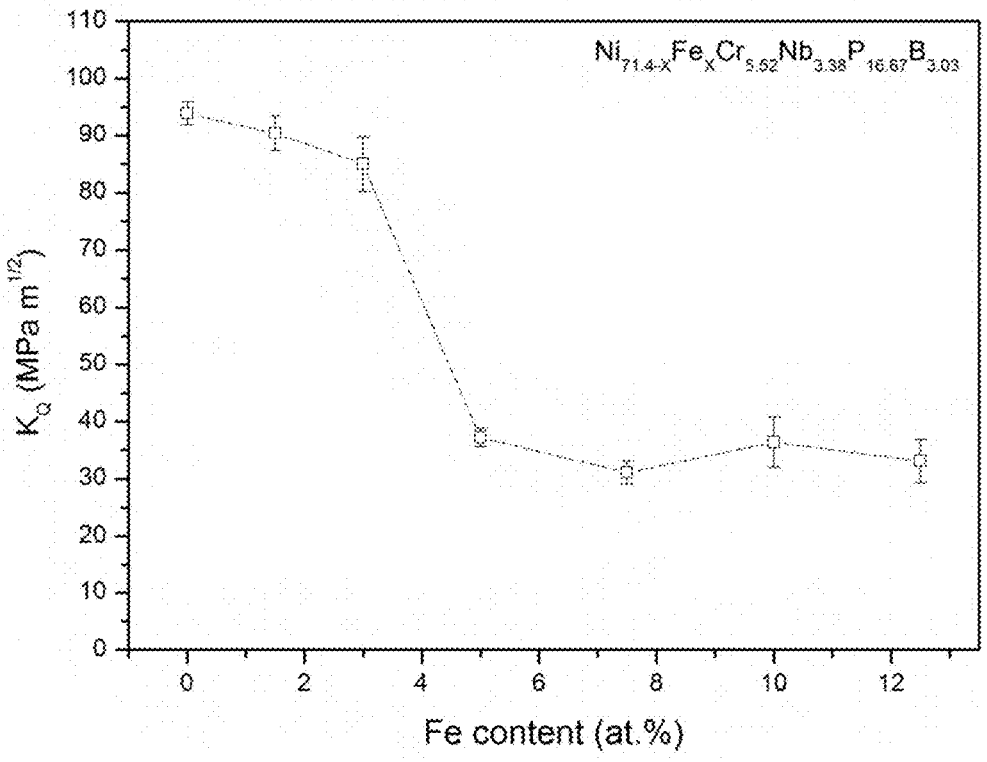
FIG. 4 provides a data plot showing the effect of varying the Ni and Fe atomic percent on the notch toughness of $Ni_{71.4-x}Fe_xCr_{5.52}Nb_{3.38}P_{16.67}B_{3.03}$ metallic glasses for $0 \le x \le 15$, in accordance with embodiments of the disclosure.

FIG. 3 provides a data plot showing the effect of varying the Ni and Fe atomic percent x on the glass forming ability of alloys according to the composition formula $Ni_{71.4-x}Fe_xCr_{5.52}Nb_{3.38}P_{16.67}B_{3.03}$. FIG. 4 provides a data plot showing the effect of varying the Ni and Fe atomic percent x on the notch toughness of metallic glasses according to the composition formula $Ni_{71.4-x}Fe_xCr_{5.52}Nb_{3.38}P_{16.67}B_{3.03}$. As shown in Table 2 and FIG. 3, alloys that satisfy the disclosed compositional range given by Eq. (2) have critical rod diameters of at least 1 mm, and as high as 9 mm. Also, as shown in Table 1 and FIG. 2, alloys that satisfy the disclosed compositional range given by Eq. (2) demonstrate a notch of at least 30 MPa $m^{1/2}$, and as high as 90 MPa $m^{1/2}$. Specifically, Sample alloys 10 and 11 demonstrate a critical rod diameter of at least 7 mm and a notch toughness of at least 85 MPa $m^{1/2}$.

Therefore, in some embodiments, Ni—Fe—Cr—Nb—P—B alloys according to the disclosure where the atomic percent a ranges from 0.5 to 5, b ranges from 4 to 7, c ranges from 2.5 to 3.5, d ranges from 16 to 17, and e ranges from 2.5 to 3.5 demonstrate a critical rod diameter of at least 7 mm, and the notch toughness of the metallic glass is at least 85 MPa $m^{1/2}$.

In other embodiments, Ni—Fe—Cr—Nb—P—B metallic glasses according to Eq. (2) of the disclosure exhibit a difference between the crystallization temperature $T_x$ and the glass transition temperature $T_g$, $\Delta T_x=T_x-T_g$, measured at heating rate of 20 K/min, that is unexpectedly higher than the corresponding Fe-free metallic glasses.

Figure 5:
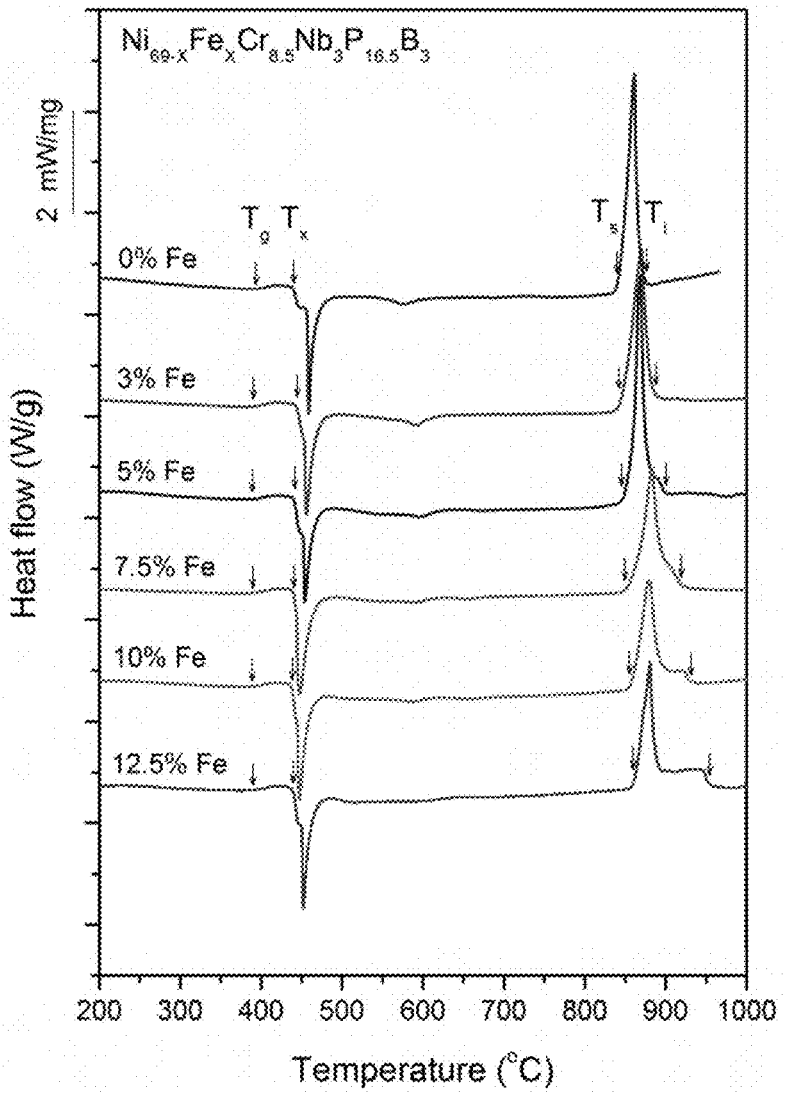
FIG. 5 provides calorimetry scans for sample metallic glasses $Ni_{69-x}Fe_xCr_{8.5}Nb_3P_{16.5}B_3$ in accordance with embodiments of the disclosure. The glass transition temperature $T_g$, crystallization temperature $T_x$, solidus temperature $T_s$, and liquidus temperature $T_l$ are indicated by arrows.
Figure 6:
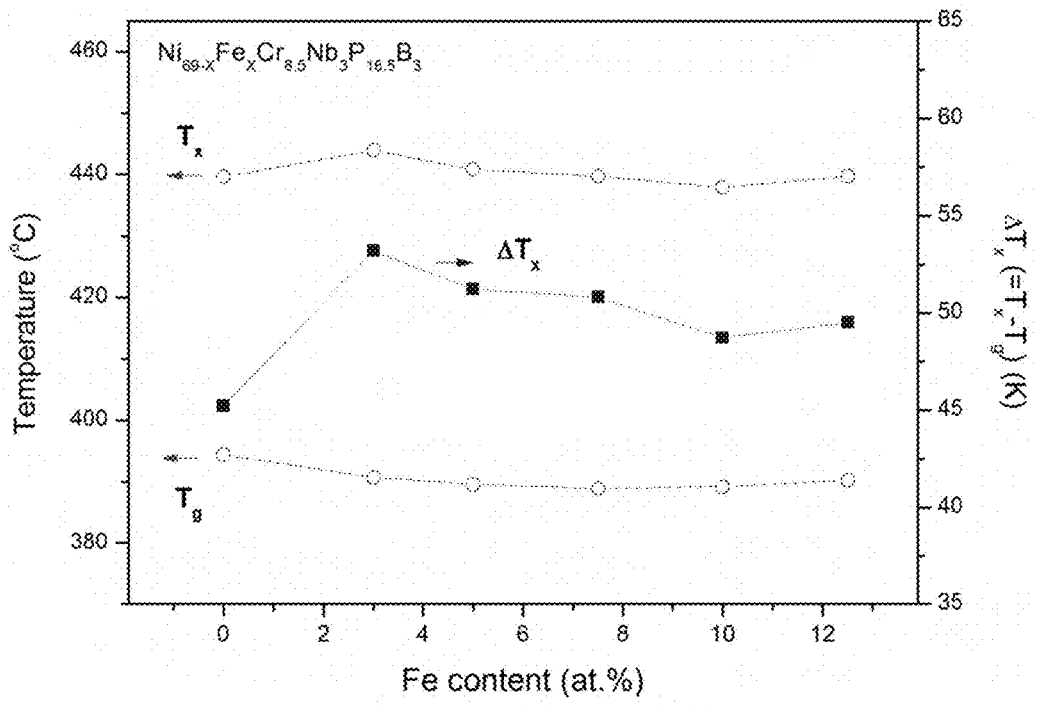
FIG. 6 provides a data plot showing the effect of varying the Ni and Fe atomic percent on the glass transition temperature $T_g$, crystallization temperature $T_x$, and difference $\Delta T_x = T_x - T_g$ of $Ni_{69-x}Fe_xCr_{8.5}Nb_3P_{16.5}B_3$ metallic glasses for $0 \le x \le 12.5$, in accordance with embodiments of the disclosure.

FIG. 5 provides calorimetry scans for sample metallic glasses $Ni_{69-x}Fe_xCr_{8.5}Nb_3P_{16.5}B_3$ in accordance with embodiments of the disclosure. The glass transition temperature $T_g$, crystallization temperature $T_x$, solidus temperature $T_s$, and liquidus temperature $T_l$ are indicated by arrows in FIG. 5. Table 3 lists the glass transition temperature $T_g$, crystallization temperature $T_x$, solidus temperature $T_s$, and liquidus temperature $T_l$ along with the respective $\Delta T_x$ value for sample metallic glasses $Ni_{69-x}Fe_xCr_{8.5}Nb_3P_{16.5}B_3$ in accordance with embodiments of the disclosure. FIG. 6 provides a data plot showing the effect of varying the Ni and Fe atomic percent on the glass transition temperature $T_g$, crystallization temperature $T_x$, and difference $\Delta T_x=T_x-T_g$ of $Ni_{69-x}Fe_xCr_{8.5}Nb_3P_{16.5}B_3$ metallic glasses for $0.5 \le x \le 12.5$.

TABLE 3

Effect of increasing the Fe atomic concentration at the expense of Ni on the glass-transition temperature $T_g$, crystallization temperature $T_x$, $\Delta T_x = T_x - T_g$, solidus temperature $T_s$, and liquidus temperature $T_l$ of the $Ni_{69}Cr_{8.5}Nb_3P_{16.5}B_3$ alloy and metallic glass.

| Sample | Composition | $T_g$ (° C.) | $T_x$ (° C.) | $\Delta T_x$ (K) | $T_s$ (° C.) | $T_l$ (° C.) |
|---|---|---|---|---|---|---|
| 1 | $Ni_{69}Cr_{8.5}Nb_3P_{16.5}B_3$ | 394.4 | 439.6 | 45.2 | 841.7 | 867.4 |
| 3 | $Ni_{66}Fe_3Cr_{8.5}Nb_3P_{16.5}B_3$ | 390.7 | 443.9 | 53.2 | 842.8 | 881.8 |
| 4 | $Ni_{64}Fe_5Cr_{8.5}Nb_3P_{16.5}B_3$ | 389.6 | 440.8 | 51.2 | 848.1 | 898.3 |
| 5 | $Ni_{61.5}Fe_{7.5}Cr_{8.5}Nb_3P_{16.5}B_3$ | 388.9 | 439.7 | 50.8 | 852.7 | 920.2 |
| 6 | $Ni_{59}Fe_{10}Cr_{8.5}Nb_3P_{16.5}B_3$ | 389.2 | 437.9 | 48.7 | 857.0 | 930.9 |
| 7 | $Ni_{56.5}Fe_{12.5}Cr_{8.5}Nb_3P_{16.5}B_3$ | 390.2 | 439.7 | 49.5 | 860.2 | 952.3 |

As shown in FIGS. 5 and 6, and Table 3, $\Delta T_x$ values are unexpectedly larger when the Fe atomic percent is between 0.5 and 12.5 compared to the value of the Fe-free alloy. Specifically, the $\Delta T_x$ value for the Fe-free metallic glass $Ni_{69}Cr_{8.5}Nb_3P_{16.5}B_3$ is 45.2° C. The $\Delta T_x$ values for $Ni_{69-x}Fe_xCr_{8.5}Nb_3P_{16.5}B_3$ metallic glasses for $0.5 \le x \le 12.5$ are all larger than 46° C., and particularly the value for the metallic glass $Ni_{66}Fe_3Cr_{8.5}Nb_3P_{16.5}B_3$ is 53.2° C.

Therefore, in some embodiments, Ni—Fe—Cr—Nb—P—B metallic glasses according to Eq. (2) of the disclosure where the atomic percent a ranges from 0.5 to 15, b ranges from 5 to 12, c ranges from 2 to 4, d ranges from 15.5 to 17.5, and e ranges from 2 to 4 exhibit a difference between the crystallization temperature $T_x$ and the glass transition temperature $T_g$, $\Delta T_x=T_x-T_g$, measured at heating rate of 20 K/min, of at least 46° C. (samples 3-7). In other embodiments, Ni—Fe—Cr—Nb—P—B metallic glasses according to Eq. (2) of the disclosure where the atomic percent a ranges from 0.5 to 10, b ranges from 7.5 to 9.5, c ranges from 2.5 to 3.5, d ranges from 16 to 17, and e ranges from 2.5 to 3.5 exhibit a difference between the crystallization temperature $T_x$ and the glass transition temperature $T_g$, $\Delta T_x=T_x-T_g$, measured at heating rate of 20 K/min, of at least 50° C. (samples 3-5).

Figure 7:
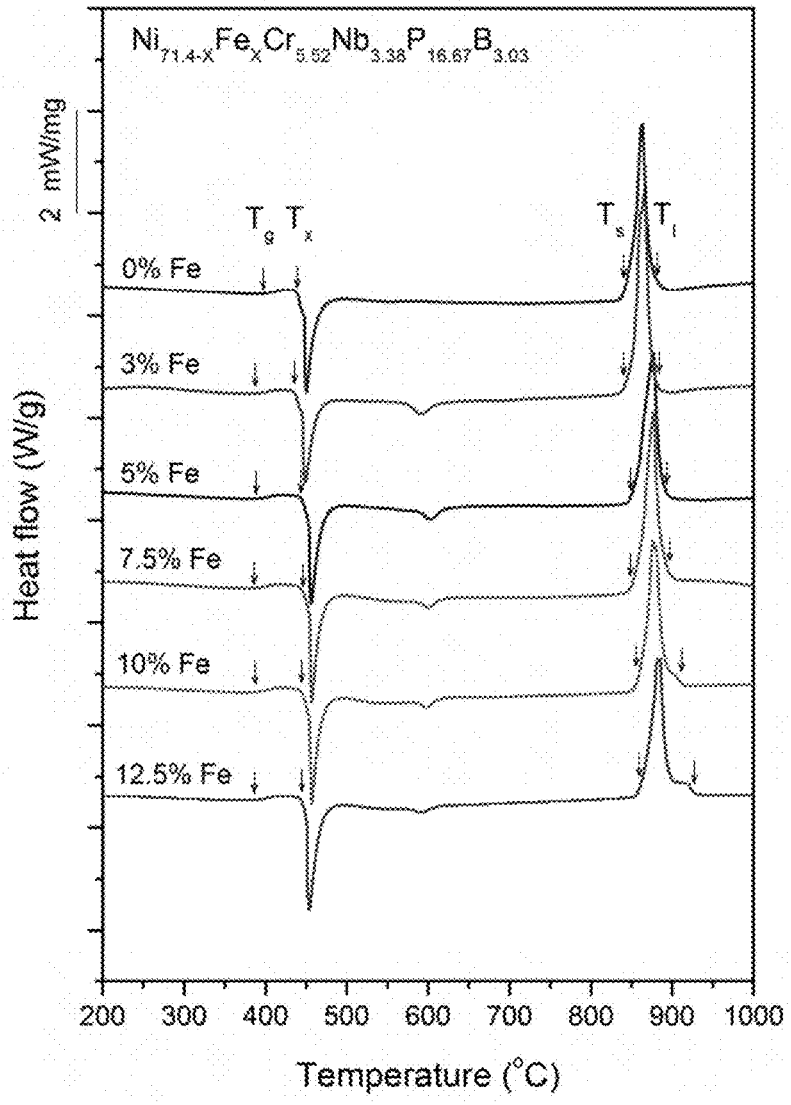
FIG. 7 provides calorimetry scans for sample metallic glasses $Ni_{71.4-x}Fe_xCr_{5.52}Nb_{3.38}P_{16.67}B_{3.03}$ in accordance with embodiments of the disclosure. The glass transition temperature $T_g$, crystallization temperature $T_x$, solidus temperature $T_s$, and liquidus temperature $T_l$ are indicated by arrows.
Figure 8:
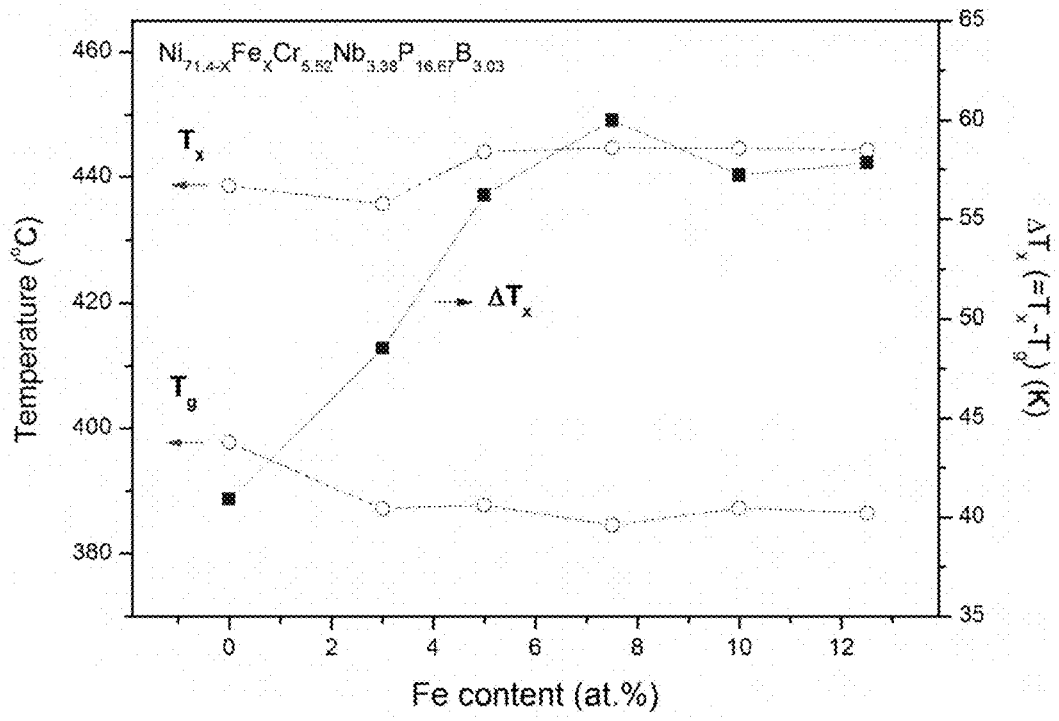
FIG. 8 provides a data plot showing the effect of varying the Ni and Fe atomic percent on the glass transition temperature $T_g$, crystallization temperature $T_x$, and difference $\Delta T_x = T_x - T_g$ of $Ni_{71.4-x}Fe_xCr_{5.52}Nb_{3.38}P_{16.67}B_{3.03}$ metallic glasses for $0 \le x \le 12.5$, in accordance with embodiments of the disclosure.

FIG. 7 provides calorimetry scans for sample metallic glasses $Ni_{71.4-x}Fe_xCr_{5.52}Nb_{3.38}P_{16.67}B_{3.03}$ in accordance with embodiments of the disclosure. The glass transition temperature $T_g$, crystallization temperature $T_x$, solidus temperature $T_s$, and liquidus temperature, $T_l$ are indicated by arrows in FIG. 7. Table 4 lists the glass transition temperature $T_g$, crystallization temperature $T_x$, solidus temperature $T_s$, and liquidus temperature $T_l$ along with the respective $\Delta T_x$ value for sample metallic glasses $Ni_{71.4-x}Fe_xCr_{5.52}Nb_{3.38}P_{16.67}B_{3.03}$ in accordance with embodiments of the disclosure. FIG. 8 provides a data plot showing the effect of varying the Ni and Fe atomic percent on the glass transition temperature $T_g$, crystallization temperature $T_x$, and difference $\Delta T_x=T_x-T_g$ of $Ni_{71.4-x}Fe_xCr_{5.52}Nb_{3.38}P_{16.67}B_{3.03}$ metallic glasses for $0.5 \le x \le 12.5$.

TABLE 4

Effect of increasing the Fe atomic concentration at the expense of Ni on the glass-transition temperature $T_g$, crystallization temperature $T_x$, $\Delta T_x = T_x - T_g$, solidus temperature $T_s$, and liquidus temperature $T_l$ of the $Ni_{71.4}Cr_{5.52}Nb_{3.38}P_{16.67}B_{3.03}$ alloy and metallic glass.

| Sample | Composition | $T_g$ (° C.) | $T_x$ (° C.) | $\Delta T_x$ (K) | $T_s$ (° C.) | $T_l$ (° C.) |
|---|---|---|---|---|---|---|
| 9 | $Ni_{71.4}Cr_{5.52}Nb_{3.38}P_{16.67}B_{3.03}$ | 397.7 | 438.6 | 40.9 | 841.8 | 872.7 |
| 11 | $Ni_{68.4}Fe_3Cr_{5.52}Nb_{3.38}P_{16.67}B_{3.03}$ | 387.2 | 435.7 | 48.5 | 839.3 | 873.6 |
| 12 | $Ni_{66.4}Fe_5Cr_{5.52}Nb_{3.38}P_{16.67}B_{3.03}$ | 387.8 | 444.0 | 56.2 | 847.6 | 886.8 |
| 13 | $Ni_{53.9}Fe_{7.5}Cr_{5.52}Nb_{3.38}P_{16.67}B_{3.03}$ | 384.6 | 444.6 | 60.0 | 849.8 | 896.1 |
| 14 | $Ni_{61.4}Fe_{10}Cr_{5.52}Nb_{3.38}P_{16.67}B_{3.03}$ | 387.3 | 444.5 | 57.2 | 855.3 | 911.7 |
| 15 | $Ni_{58.9}Fe_{12.5}Cr_{5.52}Nb_{3.38}P_{16.67}B_{3.03}$ | 386.5 | 444.3 | 57.8 | 859.5 | 927.1 |

As shown in FIGS. 7 and 8, and Table 4, $\Delta T_x$ values are unexpectedly larger when the Fe atomic percent is between 0.5 and 12.5 compared to the value of the Fe-free alloy. Specifically, the $\Delta T_x$ value for the Fe-free metallic glass $Ni_{71.4}Cr_{5.52}Nb_{3.38}P_{16.67}B_{3.03}$ is 40.9° C. The $\Delta T_x$ values for $Ni_{69-x}Fe_xCr_{8.5}Nb_3P_{16.5}B_3$ metallic glasses for $0.5 \leq x \leq 12.5$ are all larger than 41° C., and particularly the value for the metallic glass $Ni_{53.9}Fe_{7.5}Cr_{5.52}Nb_{3.38}P_{16.67}B_{3.03}$ is 60° C.

Therefore, in some embodiments, Ni—Fe—Cr—Nb—P—B metallic glasses according to Eq. (2) of the disclosure where the atomic percent a ranges from 0.5 to 12.5, b ranges from 3 to 13, c is determined by $x-y \cdot b$, where x ranges from 3.8 to 4.2 and y ranges from 0.11 to 0.14, d ranges from 15.5 to 17.5, e ranges from 2 to 4, and wherein the difference between the crystallization temperature $T_x$ and the glass transition temperature $T_g$, $\Delta T_x = T_x - T_g$, measured at heating rate of 20 K/min, is at least 41° C. (Samples 11-15). In other embodiments, Ni—Fe—Cr—Nb—P—B metallic glasses according to Eq. (2) of the disclosure where the atomic percent a ranges from 0.5 to 10, b ranges from 4 to 7, c ranges from 3.5 to 3.5, d ranges from 16 to 17, e ranges from 2.5 to 3.5, and wherein the difference between the crystallization temperature $T_x$ and the glass transition temperature $T_g$, $\Delta T_x = T_x - T_g$, measured at heating rate of 20 K/min, is at least 50° C. (samples 12-15).

Ni—Co—Cr—Nb—P—B Alloys and Metallic Glasses Compositions

In other embodiments, Ni—Co—Cr—Nb—P—B alloys that fall within the compositional range of the disclosure have a critical rod diameter of at least 3 mm can be represented by the following formula (subscripts denote atomic percent):

$$Ni_{(100-a-b-c-d-e)}Co_aCr_bNb_cP_dB_e \quad \text{Eq. (3)}$$

where: a ranges from 0.5 to 30, b ranges from 2 to 15, c ranges from 1 to 5, d ranges from 14 to 19, and e ranges from 1 to 5. In other embodiments, the atomic percent of Co, a, ranges from greater than 2 to 30. In yet other embodiments, the atomic percent of Co, a, ranges from greater than 4 to 15

In other embodiments, Ni—Co—Cr—Nb—P—B alloys according to the disclosure where the atomic percent of Co a ranges from 0.5 to 3, b ranges from 8 to 9.5, c ranges from 2.75 to 3.25, d ranges from 16.25 to 16.75, e ranges from 2.75 to 3.25 are capable of forming a metallic glass having a critical rod diameter of at least 10 mm, and the notch toughness of the metallic glass is at least 80 MPa $m^{1/2}$. Specifically, in some embodiments, alloys within this range have critical rod diameters of at least 11 mm and notch toughness as high as about 84 MPa $m^{1/2}$. Both glass-forming ability and notch toughness are unexpectedly higher than those of Co-free alloys comprising Cr, Nb, P, and B within the same ranges, which are capable of forming metallic glass having critical rod diameters of at least 10 mm and exhibit a notch toughness of about 77 MPa $m^{1/2}$.

In other embodiments, Ni—Co—Cr—Nb—P—B alloys according to the disclosure where the atomic percent of Co a ranges from 0.5 to 3, b ranges from 5 to 6, c ranges from 3.25 to 3.75, d ranges from 16.25 to 16.75, e ranges from 2.75 to 3.25 have critical rod diameters of at least 9 mm, and the notch toughness of the metallic glass is at least 94 MPa $m^{1/2}$. Specifically, in some embodiments, these alloys, (e.g. sample 11 of Table 6) have critical rod diameters of at least 9 mm and notch toughness as high as 104 MPa $m^{1/2}$. The glass-forming ability is slightly lower, but the notch toughness is unexpectedly higher than Co-free alloys comprising Cr, Nb, P, and B within the same ranges. The Co-free alloys have critical rod diameters of at least 11 mm and exhibit notch toughness of less than 94 MPa $m^{1/2}$.

Specific embodiments of metallic glasses formed from alloys with compositions according to the formula $Ni_{69-x}Co_xCr_{8.5}Nb_3P_{16.5}B_3$ are presented in Table 5. The critical rod diameters of sample alloys, along with the notch toughness of corresponding metallic glasses, are also listed in Table 5. In Table 5, Sample 1 with composition $Ni_{69}Cr_{8.5}Nb_3P_{16.5}B_3$ is free of Co and is disclosed in U.S. patent application Ser. No. 13/592,095, exhibiting a critical rod diameter of 10 mm and a notch toughness of 77 MPa $m^{1/2}$.

TABLE 5

Sample metallic glasses demonstrating the effect of increasing the Co atomic concentration at the expense of Ni on the glass forming ability and notch toughness of the $Ni_{69-x}Co_xNb_3P_{16.5}B_3$ alloy and metallic glass, respectively.

| Sample | Composition | Critical Rod Diameter [mm] | Notch Toughness $K_Q$ [MPa $m^{1/2}$] |
|---|---|---|---|
| 1 | $Ni_{69}Cr_{8.5}Nb_3P_{16.5}B_3$ | 10 | 77.0 ± 6.1 |
| 2 | $Ni_{67.5}Co_{1.5}Cr_{8.5}Nb_3P_{16.5}B_3$ | 11 | 84.3 ± 1.3 |
| 3 | $Ni_{66}Co_3Cr_{8.5}Nb_3P_{16.5}B_3$ | 10 | 83.7 ± 4.0 |
| 4 | $Ni_{64}Co_5Cr_{8.5}Nb_3P_{16.5}B_3$ | 9 | 68.3 ± 1.2 |
| 5 | $Ni_{59}Co_{10}Cr_{8.5}Nb_3P_{16.5}B_3$ | 8 | 67.2 ± 3.2 |
| 6 | $Ni_{54}Co_{15}Cr_{8.5}Nb_3P_{16.5}B_3$ | 8 | 65.1 ± 0.7 |
| 7 | $Ni_{49}Co_{20}Cr_{8.5}Nb_3P_{16.5}B_3$ | 7 | 58.2 ± 4.1 |
| 8 | $Ni_{44}Co_{25}Cr_{8.5}Nb_3P_{16.5}B_3$ | 5 | 53.7 ± 0.9 |
| 9 | $Ni_{39}Co_{30}Cr_{8.5}Nb_3P_{16.5}B_3$ | 4 | 49.9 ± 3.6 |

Figure 9:
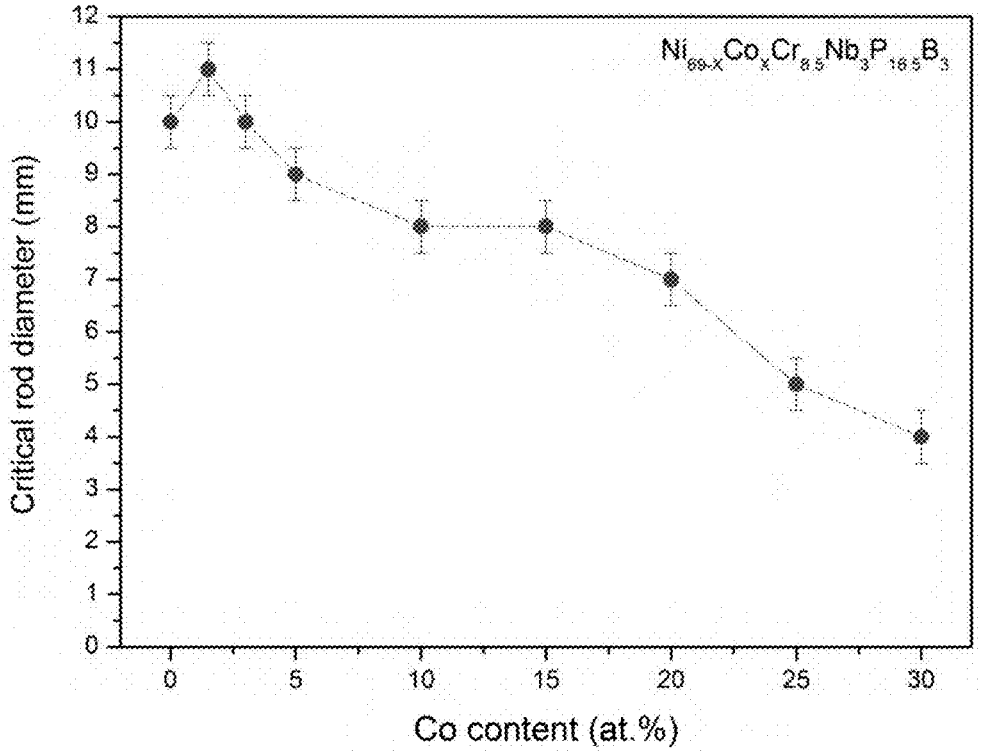
FIG. 9 provides a data plot showing the effect of varying the Ni and Co atomic percent on the glass forming ability of $Ni_{69-x}Co_xCr_{8.5}Nb_3P_{16.5}B_3$ alloys for $0 \le x \le 30$, in accordance with embodiments of the disclosure.

FIG. 9 provides a data plot showing the effect of varying the Ni and Co atomic percent on the glass forming ability of alloys according to the composition formula $Ni_{69-x}Co_xCr_{8.5}Nb_3P_{16.5}B_3$.

Figure 10:
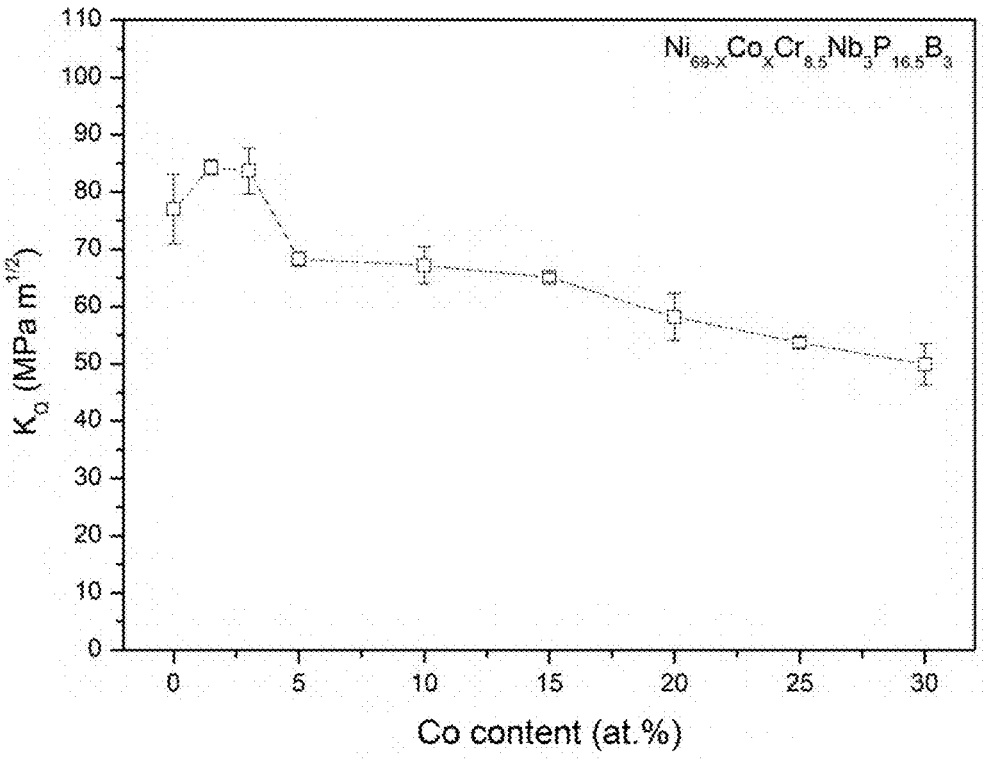
FIG. 10 provides a data plot showing the effect of varying the Ni and Co atomic percent on the notch toughness of $Ni_{69-x}Co_xCr_{8.5}Nb_3P_{16.5}B_3$ metallic glasses for $0 \le x \le 30$, in accordance with embodiments of the disclosure.

FIG. 10 provides a data plot showing the effect of varying the Ni and Co atomic percent on the notch toughness of metallic glasses according to the composition formula $Ni_{69-x}Co_xCr_{8.5}Nb_3P_{16.5}B_3$.

As shown in Table 5 and FIG. 9, alloys that satisfy the disclosed compositional range given by Eq. (3) have critical rod diameters of at least 3 mm. Also, as shown in Table 5 and FIGS. 9 and 10, when Co varies between 0.5 and 3 atomic percent, both the glass forming ability of the alloy and notch toughness of the metallic glass unexpectedly increase as compared to the Co-free alloy and metallic glass. Specifically, alloy $Ni_{67.5}Co_{1.5}Cr_{8.5}Nb_3P_{16.5}B_3$ demonstrates a critical rod diameter of 11 mm, while the Co-free alloy $Ni_{69}Cr_{8.5}Nb_3P_{16.5}B_3$ demonstrates a critical rod diameter of 10 mm. Moreover, metallic glass $Ni_{67.5}Co_{1.5}Cr_{8.5}Nb_3P_{16.5}B_3$ (sample 2) demonstrates a notch toughness of 84.3 MPa $m^{1/2}$, while the Co-free alloy $Ni_{69}Cr_{8.6}Nb_3P_{16.6}B_3$ (sample 1) demonstrates a notch toughness of 77 MPa $m^{1/2}$.

Figure 11:
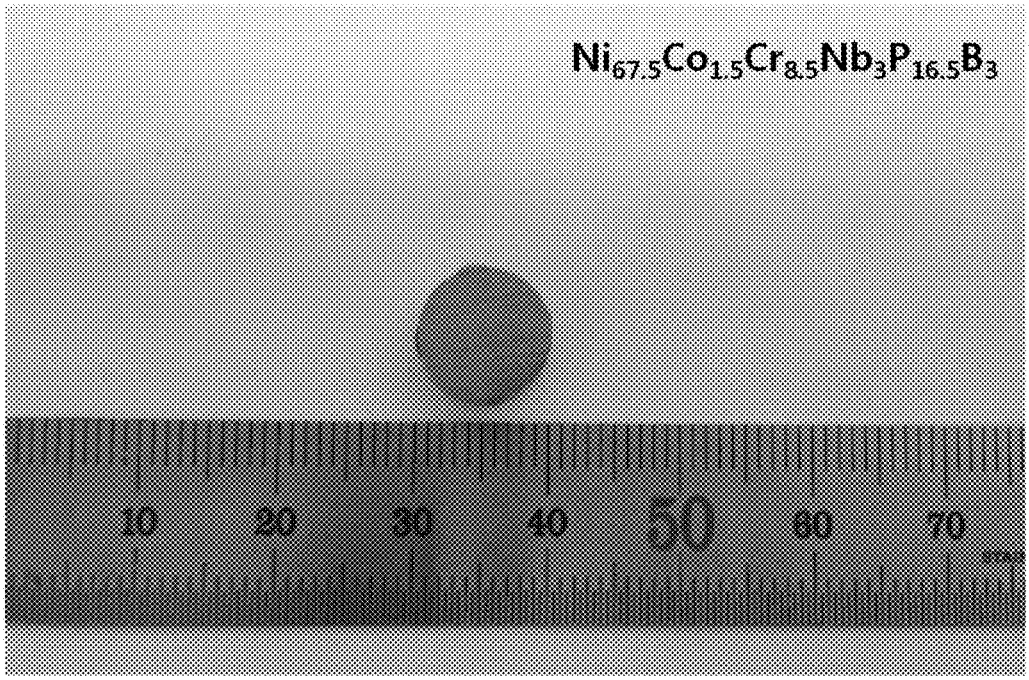
FIG. 11 provides an image of a 10-mm rod of sample metallic glass $Ni_{67.5}Co_{1.5}Cr_{8.5}Nb_3P_{16.5}B_3$, in accordance with embodiments of the disclosure, processed by water quenching the high temperature melt in a fused silica tube having a wall thickness of 1 mm.
Figure 12:
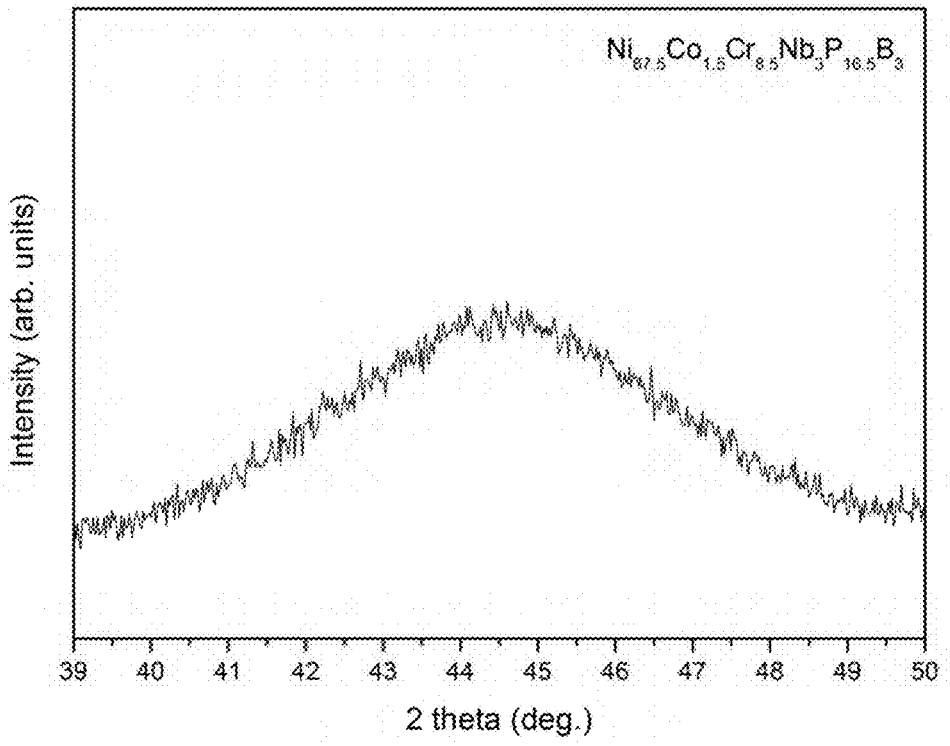
FIG. 12 provides an X-ray diffractogram verifying the amorphous structure of a 10 mm rod of sample metallic glass $Ni_{67.5}Co_{1.5}Cr_{8.5}Nb_3P_{16.5}B_3$, in accordance with embodiments of the disclosure, processed by water quenching the high temperature melt in a fused silica tube having a wall thickness of 1 mm.

FIG. 11 illustrates a 10-mm rod of metallic glass $Ni_{67.5}Co_{1.5}Cr_{8.5}Nb_3P_{16.5}B_3$ processed by water quenching the high temperature melt in a fused silica tube having a wall thickness of 1 mm. FIG. 12 illustrates an X-ray diffractogram verifying the amorphous structure of a 10 mm rod of sample metallic glass $Ni_{67.5}Co_{1.5}Cr_{8.5}Nb_3P_{16.5}B_3$ processed by water quenching the high temperature melt in a fused silica tube having a wall thickness of 1 mm.

Specific embodiments of metallic glasses formed from alloys with compositions according to the formula $Ni_{71.4-x}Co_xCr_{5.52}Nb_{3.38}P_{16.67}B_{3.03}$ are presented in Table 6. The critical rod diameters of sample alloys, along with the notch toughness of corresponding metallic glasses, are also listed in Table 6. Sample 10 with composition $Ni_{71.4}Cr_{5.52}Nb_{3.38}P_{16.67}B_{3.03}$ is free of Co and is disclosed in the previous U.S. Patent Application No. 61/720,015, exhibiting a critical rod diameter of 11 mm and a notch toughness of 94 MPa $m^{1/2}$.

TABLE 6

Sample metallic glasses demonstrating the effect of increasing the Co atomic concentration at the expense of Ni on the glass forming ability and notch toughness of the $Ni_{71.4-x}Co_xCr_{5.52}Nb_{3.38}P_{16.67}B_{3.03}$ alloy and metallic glass, respectively.

| Sample | Composition | Critical Rod Diameter [mm] | Notch Toughness $K_Q$ (MPa $m^{1/2}$) |
|---|---|---|---|
| 10 | $Ni_{71.4}Cr_{5.52}Nb_{3.38}P_{16.67}B_{3.03}$ | 11 | 93.9 ± 2.0 |
| 11 | $Ni_{69.9}Co_{1.5}Cr_{5.52}Nb_{3.38}P_{16.67}B_{3.03}$ | 9 | 103.7 ± 0.9 |
| 12 | $Ni_{68.4}Co_3Cr_{5.52}Nb_{3.38}P_{16.67}B_{3.03}$ | 9 | 84.9 ± 2.0 |
| 13 | $Ni_{66.4}Co_5Cr_{5.52}Nb_{3.38}P_{16.67}B_{3.03}$ | 9 | 86.2 ± 5.0 |
| 14 | $Ni_{61.4}Co_{10}Cr_{5.52}Nb_{3.38}P_{16.67}B_{3.03}$ | 8 | 80.3 ± 4.8 |
| 15 | $Ni_{56.4}Co_{15}Cr_{5.52}Nb_{3.38}P_{16.67}B_{3.03}$ | 7 | 72.3 ± 5.7 |
| 16 | $Ni_{51.4}Co_{20}Cr_{5.52}Nb_{3.38}P_{16.67}B_{3.03}$ | 5 | 64.3 ± 0.5 |
| 17 | $Ni_{46.4}Co_{25}Cr_{5.52}Nb_{3.38}P_{16.67}B_{3.03}$ | 5 | 39.5 ± 5.3 |
| 18 | $Ni_{41.4}Co_{30}Cr_{5.52}Nb_{3.38}P_{16.67}B_{3.03}$ | 3 | 24.2 ± 1.0 |

Figure 13:
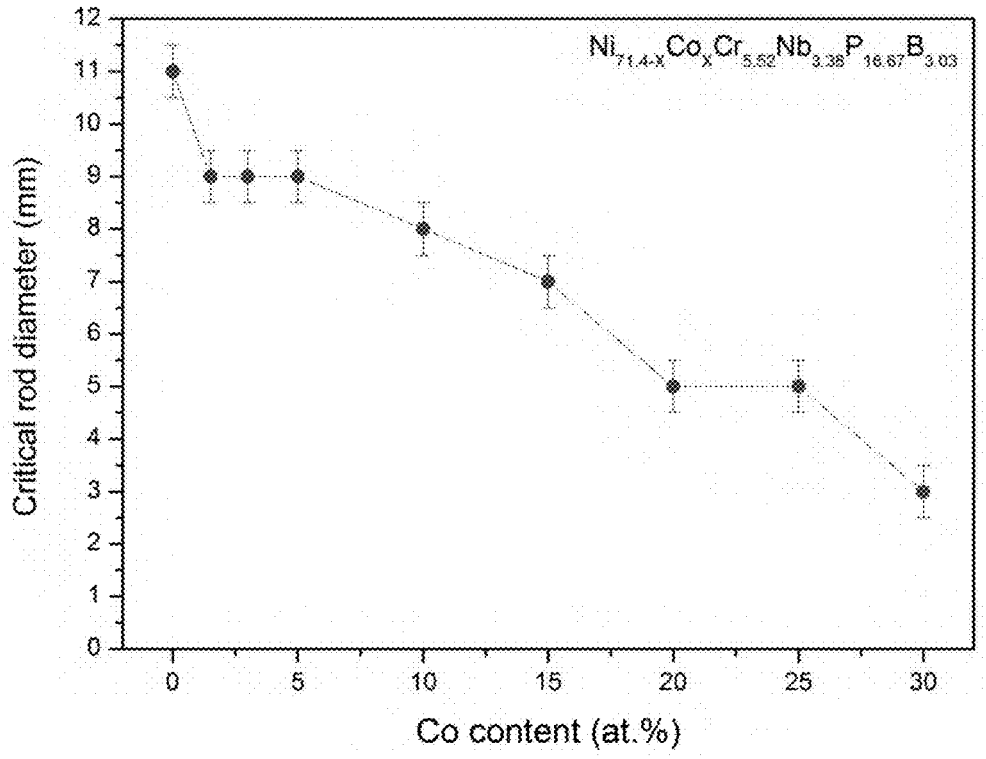
FIG. 13 provides a data plot showing the effect of varying the Ni and Co atomic percent on the glass forming ability of sample $Ni_{71.4-x}Co_xCr_{5.52}Nb_{3.38}P_{16.67}B_{3.03}$ alloys for $0 \le x \le 30$, in accordance with embodiments of the disclosure.
Figure 14:
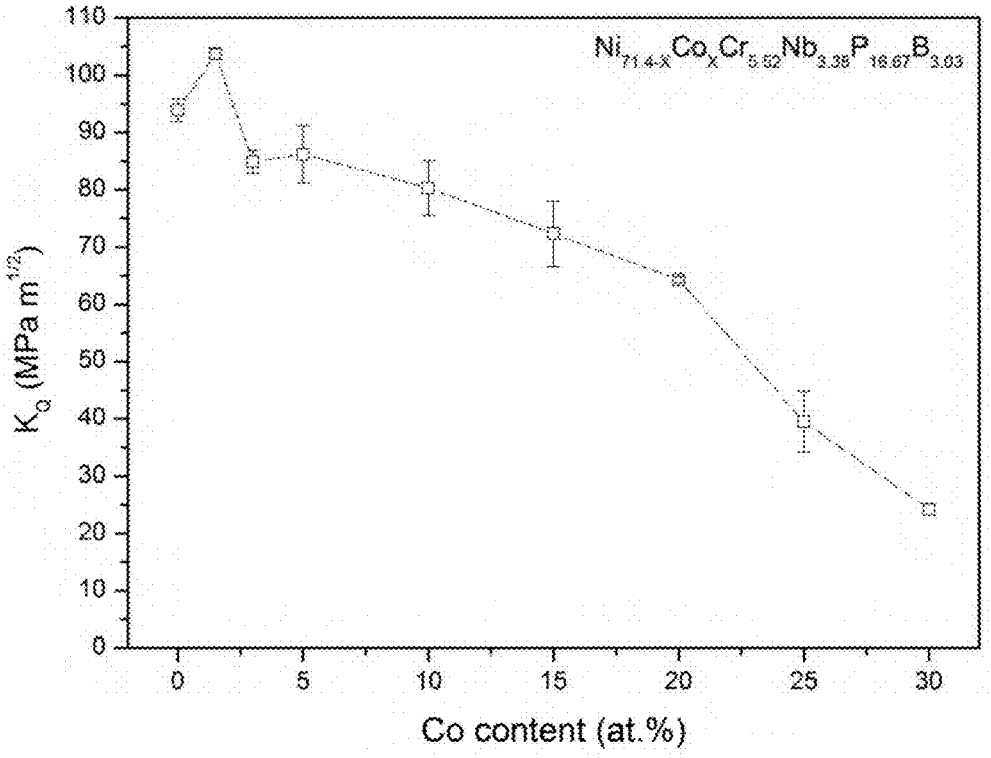
FIG. 14 provides a data plot showing the effect of varying the Ni and Co atomic percent on the notch toughness of sample $Ni_{71.4-x}Co_xCr_{5.52}Nb_{3.38}P_{16.67}B_{3.03}$ metallic glasses for $0 \le x \le 30$, in accordance with embodiments of the disclosure.

FIG. 13 provides a data plot showing the effect of varying the Ni and Co atomic percent on the glass forming ability of alloys according to the composition formula $Ni_{71.4-x}Co_xCr_{5.52}Nb_{3.38}P_{16.67}B_{3.03}$. FIG. 14 provides a data plot showing the effect of varying the Ni and Co atomic percent on the notch toughness of metallic glasses according to the composition formula $Ni_{71.4-x}Co_xCr_{5.52}Nb_{3.38}P_{16.67}B_{3.03}$.

9.5, c ranges from 2.75 to 3.25, d ranges from 16.25 to 16.75, e ranges from 2.75 to 3.25 exhibit a difference between the crystallization temperature $T_x$ and the glass transition temperature $T_g$, $\Delta T_x = T_x - T_g$, measured at heating rate of 20 K/min, of at least 46° C. (samples 2-8). Specifically, in some embodiments, alloys within this range have $\Delta T_x$ as large as 58° C. (sample 6). The $\Delta T_x$ values of the sample metallic glasses are unexpectedly higher than those of Co-free alloys comprising Cr, Nb, P, and B within the same ranges, which demonstrate $\Delta T_x$ values below 46° C. (sample 1).

In other embodiments, Ni—Co—Cr—Nb—P—B metallic glasses according to Eq. (2) of the disclosure where the atomic percent a ranges from 0.5 to 25, b ranges from 5 to 6, c ranges from 3.25 to 3.75, d ranges from 16.25 to 16.75, e ranges from 2.75 to 3.25 exhibit a difference between the crystallization temperature $T_x$ and the glass transition temperature $T_g$, $\Delta T_x = T_x - T_g$, measured at heating rate of 20 K/min, of at least 41° C. (samples 13-17). Specifically, in some embodiments, alloys within this range have a $\Delta T_x$ as large as 53° C. (sample 14). The $\Delta T_x$ values of the sample metallic glasses are unexpectedly higher than those of Co-free alloys comprising Cr, Nb, P, and B within the same ranges, which demonstrate $\Delta T_x$ values below 41° C. (sample 10).

Table 7 lists the glass transition temperature $T_g$, crystallization temperature $T_x$, solidus temperature $T_s$, and liquidus temperature $T_l$ along with the respective $\Delta T_x$ value for sample metallic glasses $Ni_{69-x}Co_xCr_{8.5}Nb_3P_{16.5}B_3$ in accordance with embodiments of the disclosure.

TABLE 7

Sample metallic glasses demonstrating the effect of increasing the Co atomic concentration at the expense of Ni on the glass-transition temperature $T_g$, crystallization temperature $T_x$, $\Delta T_x = T_x - T_g$, solidus temperature $T_s$, and liquidus temperature $T_l$ of the $Ni_{69}Cr_{8.5}Nb_3P_{16.5}B_3$ alloy and metallic glass.

| Sample | Composition | $T_g$ (° C.) | $T_x$ (° C.) | $\Delta T_x$ (° C.) | $T_s$ (° C.) | $T_l$ (° C.) |
|---|---|---|---|---|---|---|
| 1 | $Ni_{69}Cr_{8.5}Nb_3P_{16.5}B_3$ | 394.4 | 439.6 | 45.2 | 841.7 | 867.4 |
| 2 | $Ni_{67.5}Co_{1.5}Cr_{8.5}Nb_3P_{16.5}B_3$ | 396 | 443.5 | 47.5 | 846.1 | 879.2 |
| 3 | $Ni_{66}Co_3Cr_{8.5}Nb_3P_{16.5}B_3$ | 397.3 | 446.3 | 49.0 | 847.8 | 883.6 |
| 4 | $Ni_{64}Co_5Cr_{8.5}Nb_3P_{16.5}B_3$ | 398.6 | 454.4 | 55.8 | 849.2 | 889.9 |
| 5 | $Ni_{59}Co_{10}Cr_{8.5}Nb_3P_{16.5}B_3$ | 401.2 | 458.6 | 57.4 | 864.8 | 908.5 |
| 6 | $Ni_{54}Co_{15}Cr_{8.5}Nb_3P_{16.5}B_3$ | 408.5 | 466.9 | 58.4 | 876.6 | 933.5 |
| 7 | $Ni_{49}Co_{20}Cr_{8.5}Nb_3P_{16.5}B_3$ | 411.2 | 464.5 | 53.2 | 886.1 | 955.5 |
| 8 | $Ni_{44}Co_{25}Cr_{8.5}Nb_3P_{16.5}B_3$ | 416.2 | 468.8 | 52.2 | 895.1 | 973.1 |
| 9 | $Ni_{39}Co_{30}Cr_{8.5}Nb_3P_{16.5}B_3$ | 419.9 | 463.6 | 43.7 | 905.0 | 992.4 |

As shown in Table 6 and FIG. 13, alloys that satisfy the disclosed compositional range given by Eq. (3) have a critical rod diameter of at least 3 mm. Also, as shown in Table 5 and FIGS. 13 and 14, when Co varies between 0.5 and 3 atomic percent, the notch toughness of the metallic glass unexpectedly increases as compared to the Co-free alloy and metallic glass, while the glass forming ability decreases just slightly. Specifically, alloy $Ni_{69.9}Co_{1.5}Cr_{5.52}Nb_{3.38}P_{16.67}B_{3.03}$ (sample 11) demonstrates a critical rod diameter of 9 mm, while the Co-free alloy $Ni_{71.4}Cr_{5.52}Nb_{3.38}P_{16.67}B_{3.03}$ (sample 10) demonstrates a critical rod diameter of 11 mm. Moreover, metallic glass $Ni_{69.9}Co_{1.5}Cr_{5.52}Nb_{3.38}P_{16.67}B_{3.03}$ (sample 11) demonstrates a notch toughness of 103.7 MPa $m^{1/2}$, while the Co-free alloy $Ni_{71.4}Cr_{5.52}Nb_{3.38}P_{16.67}B_{3.03}$ (sample 10) demonstrates a notch toughness of 93.9 MPa $m^{1/2}$.

Figure 15:
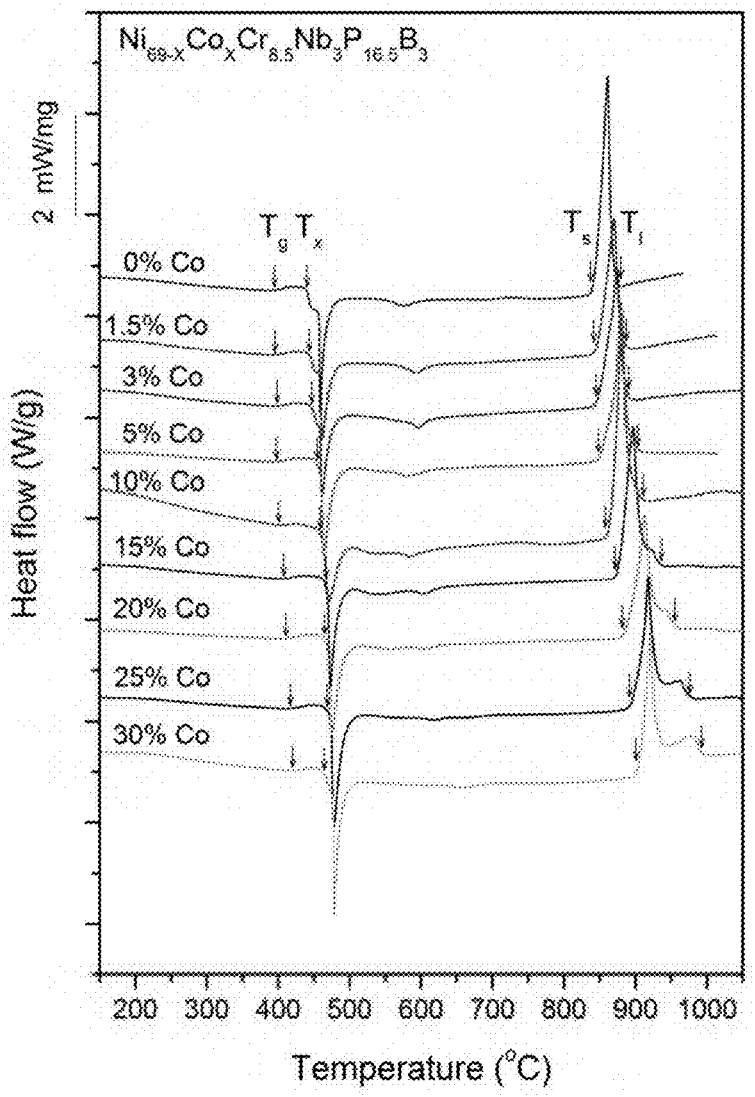
FIG. 15 provides calorimetry scans for sample metallic glasses $Ni_{69-x}Co_xCr_{8.5}Nb_3P_{16.5}B_3$ in accordance with embodiments of the disclosure. The glass transition temperature $T_g$, crystallization temperature $T_x$, solidus temperature $T_s$, and liquidus temperature $T_l$ are indicated by arrows.
Figure 16:
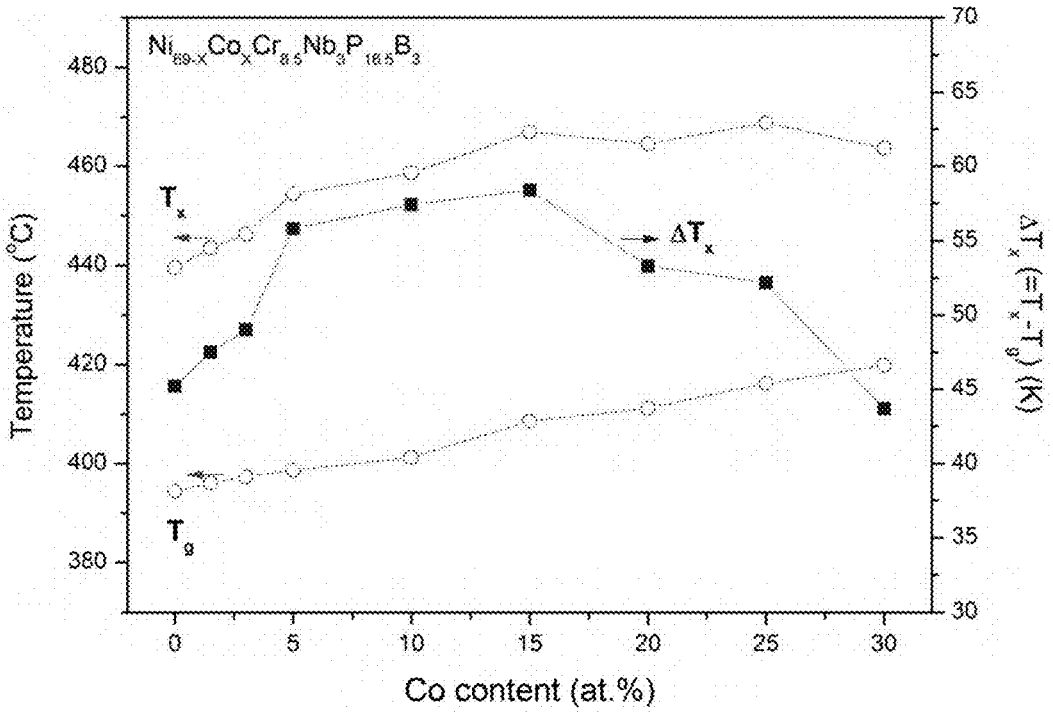
FIG. 16 provides a data plot showing the effect of varying the Ni and Co atomic percent on the glass transition temperature $T_g$, crystallization temperature $T_x$, and difference $\Delta T_x = T_x - T_g$ for sample $Ni_{69-x}Co_xCr_{8.5}Nb_3P_{16.5}B_3$ metallic glasses for $0 \le x \le 30$, in accordance with embodiments of the disclosure.

In other embodiments, Ni—Co—Cr—Nb—P—B metallic glasses according to Eq. (2) of the disclosure where the atomic percent a ranges from 0.5 to 25, b ranges from 8 to FIG. 15 provides calorimetry scans for sample metallic glasses $Ni_{69-x}Co_xCr_{8.5}Nb_3P_{16.5}B_3$ in accordance with embodiments of the disclosure. The glass transition temperature $T_g$, crystallization temperature $T_x$, solidus temperature $T_s$, and liquidus temperature, $T_l$ are indicated by arrows in FIG. 15. FIG. 16 provides a data plot showing the effect of varying the Ni and Co atomic percent on the glass transition temperature $T_g$, crystallization temperature $T_x$, and difference $\Delta T_x = T_x - T_g$ of $Ni_{69-x}Co_xCr_{8.5}Nb_3P_{16.5}B_3$ metallic glasses for $0.5 \le x \le 25$.

As shown in FIGS. 15 and 16 and Table 7, both $T_g$ and $T_x$ increase when the Co atomic percent is between 0.5 and 30 atomic percent as compared to the Co-free alloy, but $T_x$ increases more than $T_g$ such that the $\Delta T_x$ values are unexpectedly larger compared to the value of the Co-free alloy. Specifically, the $\Delta T_x$ value for the Co-free metallic glass $Ni_{69}Cr_{8.5}Nb_3P_{16.5}B_3$ is 45.2° C. The $\Delta T_x$ values for $Ni_{69-x}Co_xCr_{8.5}Nb_3P_{16.5}B_3$ metallic glasses for $0.5 \le x \le 25$ are all larger than 46° C., and when the atomic percent of Co is greater than 4 and up to 25 $\Delta T_x$ is at least 50° C. Particularly, the value for the metallic glass $Ni_{54}Co_{15}Cr_{8.5}Nb_3P_{16.5}B_3$ is 58.4° C.

Table 8 lists the glass transition temperature $T_g$, crystallization temperature $T_x$, solidus temperature $T_s$, and liquidus temperature $T_l$ along with the respective $\Delta T_x$ value for sample metallic glasses $Ni_{71.4-x}Co_xCr_{5.52}Nb_{3.38}P_{16.67}B_{3.03}$ in accordance with embodiments of the disclosure.

TABLE 8

Sample metallic glasses demonstrating the effect of increasing the Co atomic concentration at the expense of Ni on the glass-transition temperature $T_g$, crystallization temperature $T_x$, $\Delta T_x = T_x - T_g$, solidus temperature $T_s$, and liquidus temperature $T_l$ of the $Ni_{71.4}Cr_{5.52}Nb_{3.38}P_{16.67}B_{3.03}$ alloy and metallic glass.

| Sample | Composition | $T_g$ (° C.) | $T_x$ (° C.) | $\Delta T_x$ (° C.) | $T_s$ (° C.) | $T_l$ (° C.) |
|---|---|---|---|---|---|---|
| 10 | $Ni_{71.4}Cr_{5.52}Nb_{3.38}P_{16.67}B_{3.03}$ | 397.7 | 438.6 | 40.9 | 841.8 | 872.7 |
| 13 | $Ni_{66.4}Co_5Cr_{5.52}Nb_{3.38}P_{16.67}B_{3.03}$ | 398.4 | 442.4 | 44.0 | 849.7 | 875.2 |
| 14 | $Ni_{61.4}Co_{10}Cr_{5.52}Nb_{3.38}P_{16.67}B_{3.03}$ | 400.6 | 453.9 | 53.3 | 857.7 | 898.9 |
| 15 | $Ni_{56.4}Co_{15}Cr_{5.52}Nb_{3.38}P_{16.67}B_{3.03}$ | 406.0 | 458.2 | 52.2 | 870.0 | 915.9 |
| 16 | $Ni_{51.4}Co_{20}Cr_{5.52}Nb_{3.38}P_{16.67}B_{3.03}$ | 408.3 | 460.7 | 52.4 | 881.3 | 923.1 |
| 17 | $Ni_{46.4}Co_{25}Cr_{5.52}Nb_{3.38}P_{16.67}B_{3.03}$ | 414.7 | 461.7 | 47.0 | 893.2 | 945.7 |
| 18 | $Ni_{41.4}Co_{30}Cr_{5.52}Nb_{3.38}P_{16.67}B_{3.03}$ | 417.0 | 454.6 | 37.6 | 900.5 | 971.3 |

Figure 17:
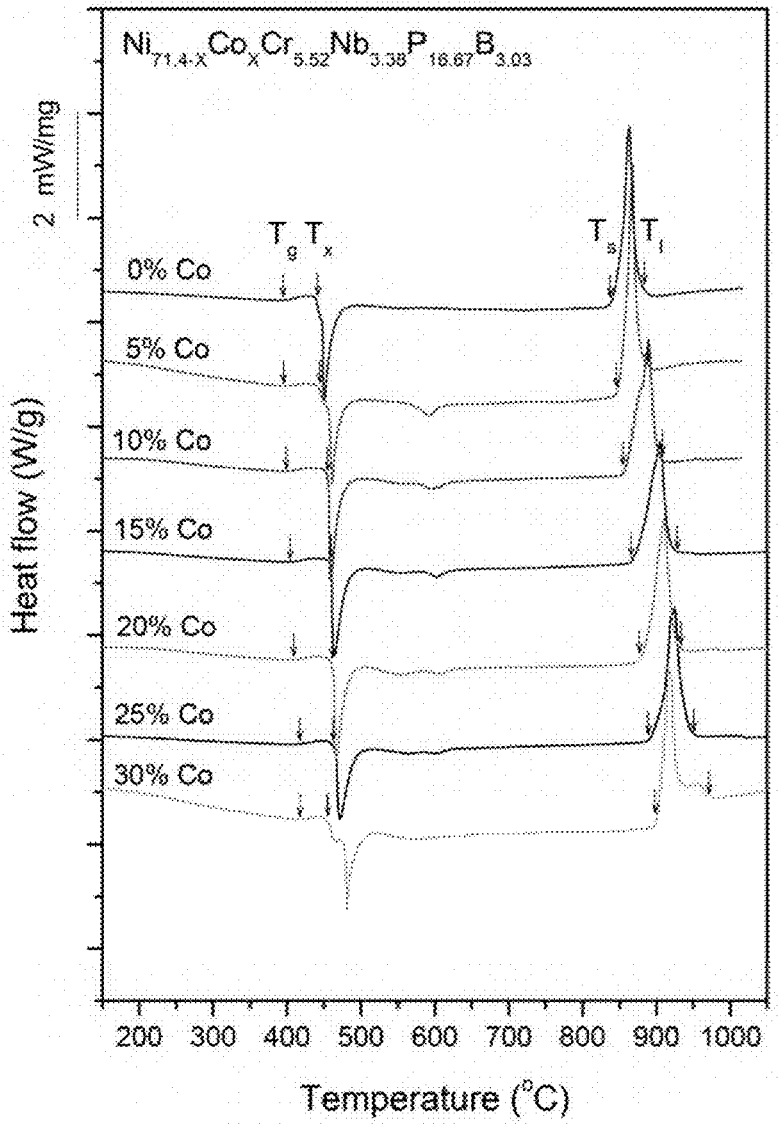
FIG. 17 provides calorimetry scans for sample metallic glasses $Ni_{71.4-x}Co_xCr_{5.52}Nb_{3.38}P_{16.67}B_{3.03}$ in accordance with embodiments of the disclosure. The glass transition temperature $T_g$, crystallization temperature $T_x$, solidus temperature $T_s$, and liquidus temperature $T_l$ are indicated by arrows.
Figure 18:
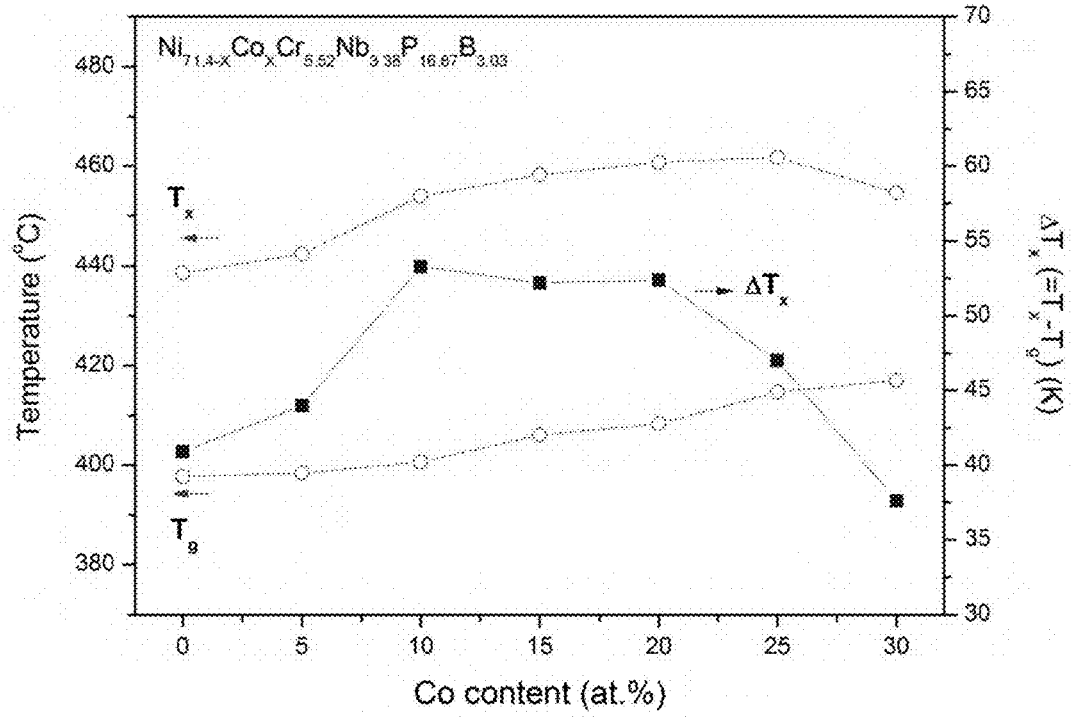
FIG. 18 provides a data plot showing the effect of varying the Ni and Co atomic percent on the glass transition temperature $T_g$, crystallization temperature $T_x$, and difference $\Delta T_x = T_x - T_g$ for sample $Ni_{71.4-x}Co_xCr_{5.52}Nb_{3.38}P_{16.67}B_{3.03}$ metallic glasses for $0 \le x \le 30$, in accordance with embodiments of the disclosure.

FIG. 17 provides calorimetry scans for sample metallic glasses $Ni_{71.4-x}Co_xCr_{5.52}Nb_{3.38}P_{16.67}B_{3.03}$ in accordance with embodiments of the disclosure. The glass transition temperature $T_g$, crystallization temperature $T_x$, solidus temperature $T_s$, and liquidus temperature $T_l$ are indicated by arrows in FIG. 17. FIG. 18 provides a data plot showing the effect of varying the Ni and Co atomic percent on the glass transition temperature $T_g$, crystallization temperature $T_x$, and difference $\Delta T_x = T_x - T_g$ of $Ni_{71.4-x}Co_xCr_{5.52}Nb_{3.38}P_{16.67}B_{3.03}$ metallic glasses for $0.5 \leq x \leq 25$.

As shown in FIGS. 17 and 18 and Table 8, both $T_g$ and $T_x$ increase when the Co atomic percent is between 0.5 and 30 atomic percent as compared to the Co-free alloy, but $T_x$ increases more than $T_g$ such that the $\Delta T_x$ values are unexpectedly larger compared to the value of the Co-free alloy. Specifically, the $\Delta T_x$ value for the Co-free metallic glass $Ni_{71.4}Cr_{5.52}Nb_{3.38}P_{16.67}B_{3.03}$ is 40.9° C. The $\Delta T_X$ values for $Ni_{71.4-x}Co_xCr_{5.52}Nb_{3.38}P_{16.67}B_{3.03}$ metallic glasses for $0.5 \leq x \leq 25$ are all larger than 41° C., and when the atomic percent of Co is greater than 4 and up to 25, $\Delta T_x$ is at least 44° C. Particularly the value for the metallic glass $Ni_{61.4}Co_{10}Cr_{5.52}Nb_{3.38}P_{16.67}B_{3.03}$ is 53.3° C.

Figure 19:
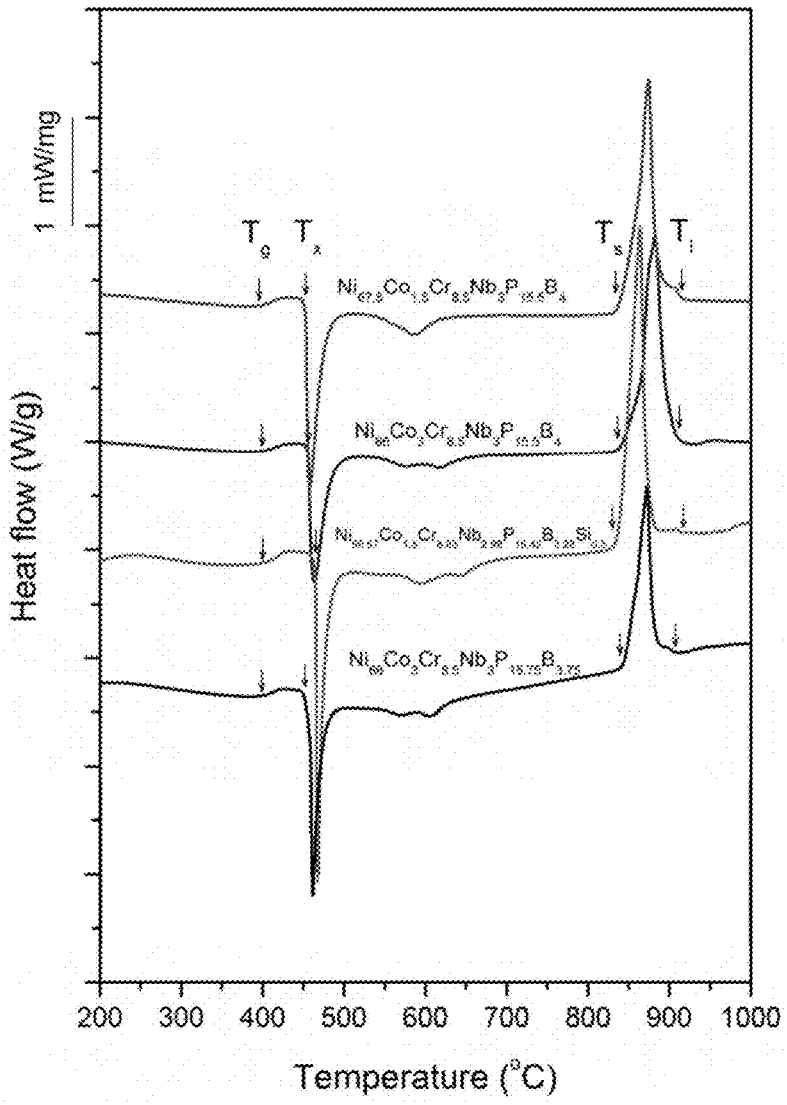
FIG. 19 provides calorimetry scans for the Ni—Co—Cr—Nb—P—B sample metallic glasses of Table 9 (Sample 19-22) in accordance with embodiments of the disclosure. The glass transition temperature $T_g$, crystallization temperature $T_x$, solidus temperature $T_s$, and liquidus temperature $T_l$ are indicated by arrows.
Figure 20:
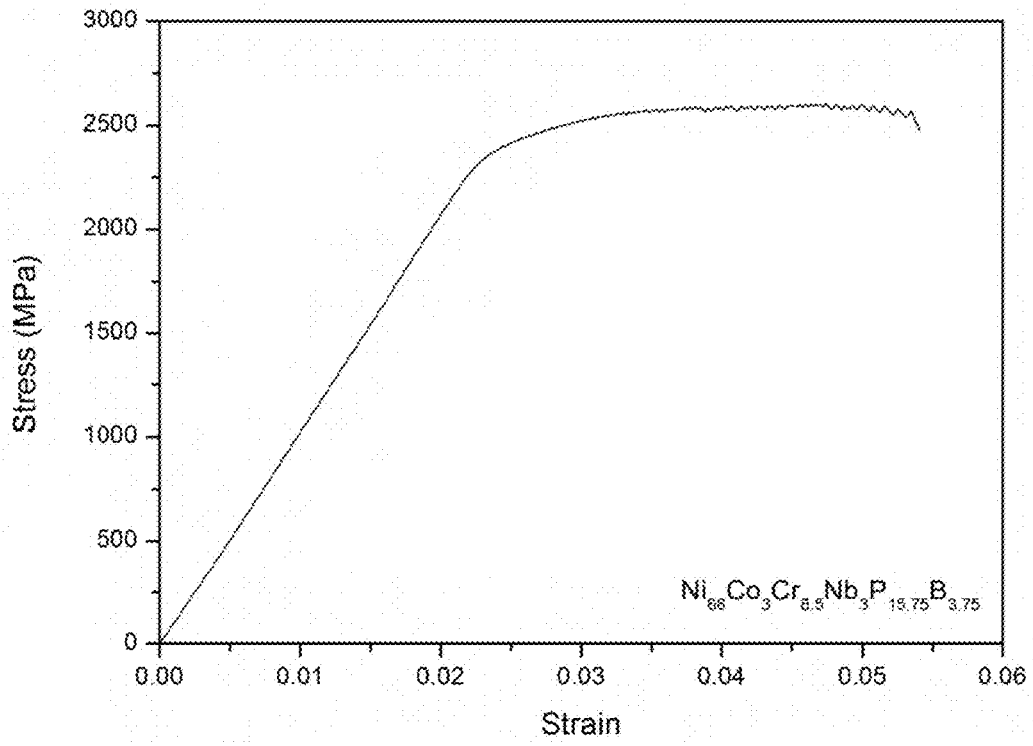
FIG. 20 provides a compressive stress-strain diagram for example metallic glass $Ni_{66}Co_3Cr_{8.5}Nb_3P_{15.75}B_{3.75}$, in accordance with embodiments of the disclosure.

Additional Ni—Co—Cr—Nb—P—B alloys and metallic glasses according to the disclosure along with their respective critical rod diameter, glass-transition temperature $T_g$, crystallization temperature $T_x$ , $\Delta T_x = T_x - T_g$, solidus temperature $T_s$, and liquidus temperature $T_l$ are presented in Table 9. FIG. 19 provides calorimetry scans for the Ni—Co—Cr—Nb—P—B sample metallic glasses of Table 9 (Sample 19-22) in accordance with embodiments of the disclosure. The glass transition temperature $T_g$, crystallization temperature $T_x$, solidus temperature $T_s$, and liquidus temperature, $T_l$ are indicated by arrows in FIG. 19. Compressive loading of metallic glass $Ni_{67.1}Cr_{10}Nb_{3.4}P_{18}Si_{1.5}$ was also performed to determine the compressive yield strength. The stress-strain diagram for sample metallic glass $Ni_{66}Co_3Cr_{8.5}Nb_3P_{15.75}B_{3.75}$ is presented in FIG. 20.

TABLE 9

Sample Ni—Co—Cr—Nb—P—B alloys and metallic along with their respective critical rod diameter, glass-transition temperature $T_g$, crystallization temperature $T_x$, $\Delta T_x = T_x - T_g$, solidus temperature $T_s$, and liquidus temperature $T_l$.

| Example | Composition | Critical Rod Diameter [mm] | $T_g$ (° C.) | $T_x$ (° C.) | $\Delta T_x$ (° C.) | $T_s$ (° C.) | $T_l$ (° C.) |
|---|---|---|---|---|---|---|---|
| 19 | $Ni_{67.5}Co_{1.5}Cr_{8.5}Nb_3P_{15.5}B_4$ | 10 | 395.4 | 453.1 | 57.7 | 837.9 | 914.9 |
| 20 | $Ni_{66}Co_3Cr_{8.5}Nb_3P_{15.5}B_4$ | 10 | 399.4 | 456.1 | 56.7 | 839.7 | 908.5 |
| 21 | $Ni_{66.67}Co_{1.5}Cr_{8.65}Nb_{2.98}P_{16.42}B_{3.28}Si_{0.5}$ | 8 | 400.1 | 465.3 | 65.2 | 836.8 | 871.2 |
| 22 | $Ni_{66}Co_3Cr_{8.5}Nb_3P_{15.75}B_{3.75}$ | 10 | 398.8 | 450.7 | 51.9 | 844.5 | 906.4 |

Figure 21:
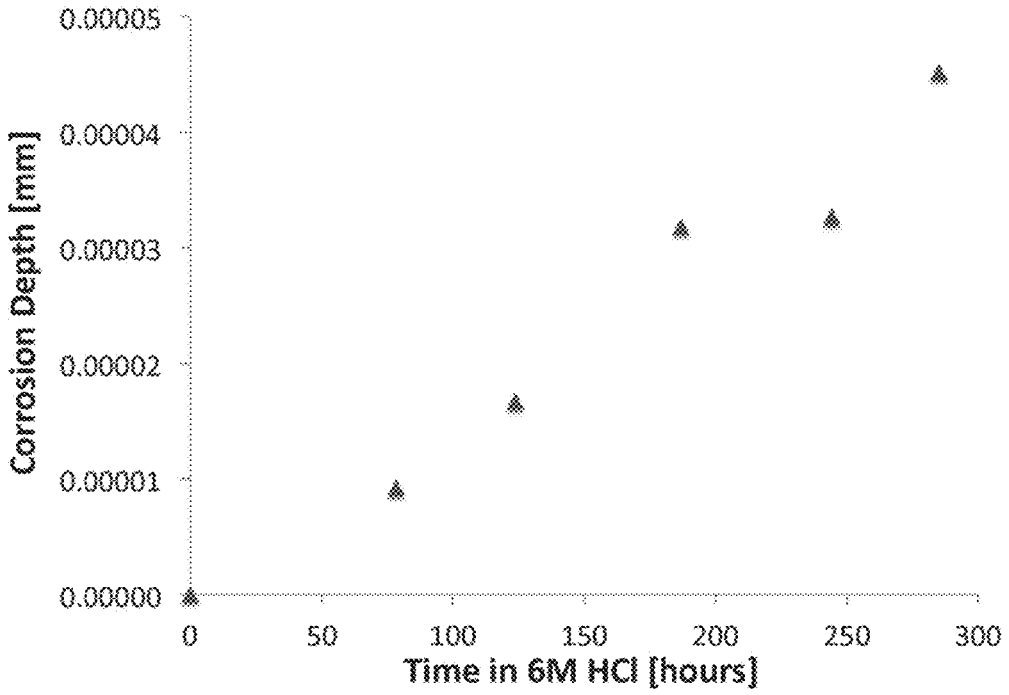
FIG. 21 provides a plot showing the corrosion depth versus time in a 6M HCl solution of a 3 mm metallic glass rod having composition $Ni_{66}Co_3Cr_{8.5}Nb_3P_{15.75}B_{3.75}$.

The metallic glasses according to the disclosure also exhibit corrosion resistance. The corrosion resistance of example metallic glass $Ni_{66}Co_3Cr_{8.5}Nb_3P_{15.75}B_{3.75}$ was evaluated by an immersion test in 6M HCl. A plot of the corrosion depth versus immersion time is presented in FIG. 21. The corrosion depth at approximately 285 hours is measured to be about 0.0452 micrometers. The corrosion rate is estimated to be 1.435 μm/year.

Various thermophysical, mechanical, and chemical properties for the alloy and metallic glass with composition $Ni_{66}Co_3Cr_{8.5}Nb_3P_{15.75}B_{3.75}$ were investigated. Measured thermophysical properties include glass-transition, crystallization, solidus and liquidus temperatures, density, shear modulus, bulk modulus, Young's modulus, and Poisson's ratio. Measured mechanical properties include hardness, notch toughness, and compressive yield strength. Measured chemical properties include corrosion resistance in 6M HCl. These properties are listed in Table 10.

TABLE 10

Thermophysical, Mechanical, and chemical properties for metallic glass $Ni_{66}Co_3Cr_{8.5}Nb_3P_{15.75}B_{3.75}$.

| | |
|---|---|
| Composition | $Ni_{66}Co_3Cr_{8.5}Nb_3P_{15.75}B_{3.75}$ |
| Critical rod diameter | 10 mm |
| Glass-transition temperature | 398.8° C. |
| Crystallization temperature | 450.7° C. |
| Solidus temperature | 844.5° C. |
| Liquidus temperature | 906.4° C. |
| Density | 7.91 g/cc |
| Hardness (HV 0.5) | 697.8 ± 2.8 kgf/mm$^2$ |
| Yield strength (compressive) | 2425 MPa |
| Notch toughness | 74.0 ± 4.0 MPa m$^{1/2}$ |
| Plastic zone radius | 0.30 mm |
| Shear modulus | 51.6 GPa |
| Bulk modulus | 183.2 GPa |
| Young's modulus | 141.6 GPa |
| Poisson's ratio | 0.371 |
| Corrosion rate (6M HCl) | 1.435 μm/year |

For the metallic glasses according to the disclosure, the notch toughness can be at least 60 MPa m$^{1/2}$, the compressive yield strength can be at least 2300 MPa, the plastic zone radius can to be at least 0.25 mm, the shear modulus can be no more than 53 GPa, the bulk modulus can be at least 175 GPa, the Poisson's ratio can be at least 0.35, the corrosion rate in 6M HCl can be under 50 μm/year.

Figure 22:
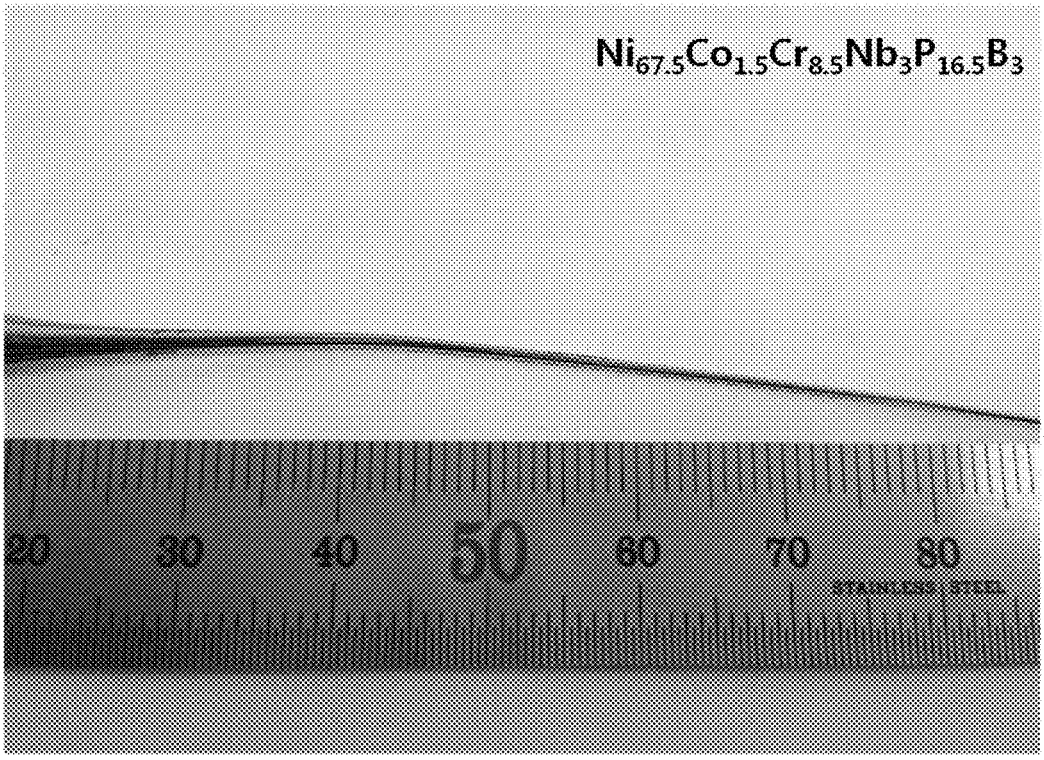
FIG. 22 provides an image of a plastically bent rod of sample metallic glass $Ni_{67.5}Co_{1.5}Cr_{8.5}Nb_3P_{16.5}B_3$ at 1 mm diameter cross section in accordance with embodiments of the disclosure.

Lastly, the Ni—Co—Cr—Nb—P—B metallic glasses according to embodiments of the disclosure exhibit an exceptional bending ductility. Specifically, under an applied bending load, the metallic glasses are capable of undergoing plastic bending in the absence of fracture at diameters of up to at least 1 mm. An amorphous plastically bent rod of a 1 mm diameter section of metallic glass $Ni_{67.5}Co_{1.5}Cr_{8.5}Nb_3P_{16.5}B_3$ (Sample 2) is shown in FIG. 22.

Ni—Cu—Cr—Nb—P—B Alloys and Metallic Glass Compositions

In some embodiments, Ni—Cu—Cr—Nb—P—B alloys that fall within the compositional range of the disclosure have a critical rod diameter of at least 1 mm can be represented by the following formula (subscripts denote atomic percent):

$$Ni_{(100-a-b-c-d-e)}Cu_aCr_bNb_cP_dB_e \quad \text{Eq. (4)}$$

where: a ranges from 0.5 to 10, b ranges from 2 to 15, c ranges from 1 to 5, d ranges from 14 to 19, and e ranges from 1 to 5. In other embodiments, the atomic percent of Cu, a, ranges from greater than 2 to 10. In yet other embodiments, the atomic percent of Cu, a, ranges from greater than 4 to 10.

Specific embodiments of metallic glasses formed from alloys with compositions according to the formula $Ni_{69-x}Cu_xCr_{8.5}Nb_3P_{16.5}B_3$ are presented in Table 11. The critical rod diameters of sample alloys, along with the notch toughness of corresponding metallic glasses, are also listed in Table 11. In Table 11, Sample 1 with composition $Ni_{69}Cr_{8.5}Nb_3P_{16.5}B_3$ is free of Cu and is disclosed in U.S. patent application Ser. No. 13/592,095, exhibiting a critical rod diameter of 10 mm and a notch toughness of 77 MPa m$^{1/2}$.

TABLE 11

Sample alloys demonstrating the effect of increasing the Cu atomic concentration at the expense of Ni on the glass forming ability and notch toughness of $Ni_{69}Cr_{8.5}Nb_3P_{16.5}B_3$ alloy and metallic glass, respectively.

| Sample | Composition | Critical Rod Diameter [mm] | Notch Toughness $K_Q$ (MPa m$^{1/2}$) |
|---|---|---|---|
| 1 | $Ni_{69}Cr_{8.5}Nb_3P_{16.5}B_3$ | 10 | 77.0 ± 6.1 |
| 2 | $Ni_{67.5}Cu_{1.5}Cr_{8.5}Nb_3P_{16.5}B_3$ | 10 | 75.9 ± 5.8 |
| 3 | $Ni_{66}Cu_3Cr_{8.5}Nb_3P_{16.5}B_3$ | 8 | 69.9 ± 4.0 |
| 4 | $Ni_{64}Cu_5Cr_{8.5}Nb_3P_{16.5}B_3$ | 6 | 36.5 ± 1.0 |
| 5 | $Ni_{59}Cu_{10}Cr_{8.5}Nb_3P_{16.5}B_3$ | 1 | — |

Figure 23:
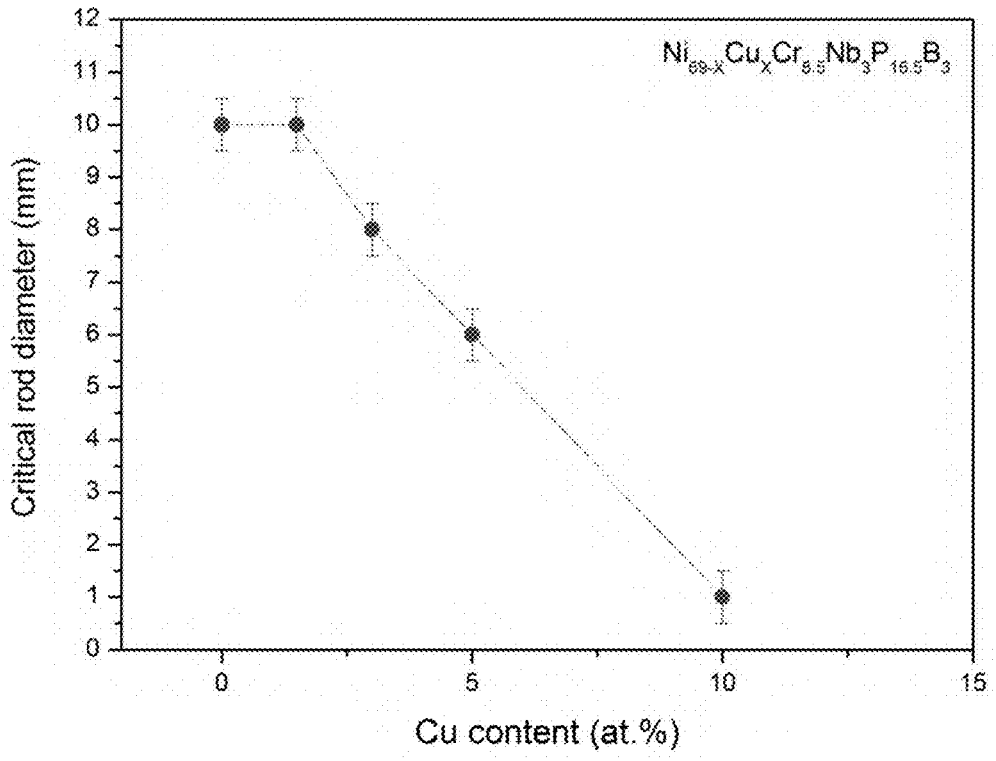
FIG. 23 provides a data plot showing the effect of varying the Ni and Cu atomic concentrations on the glass forming ability of $Ni_{69-x}Cu_xCr_{8.5}Nb_3P_{16.5}B_3$ alloys for $0 \le x \le 10$.
Figure 24:
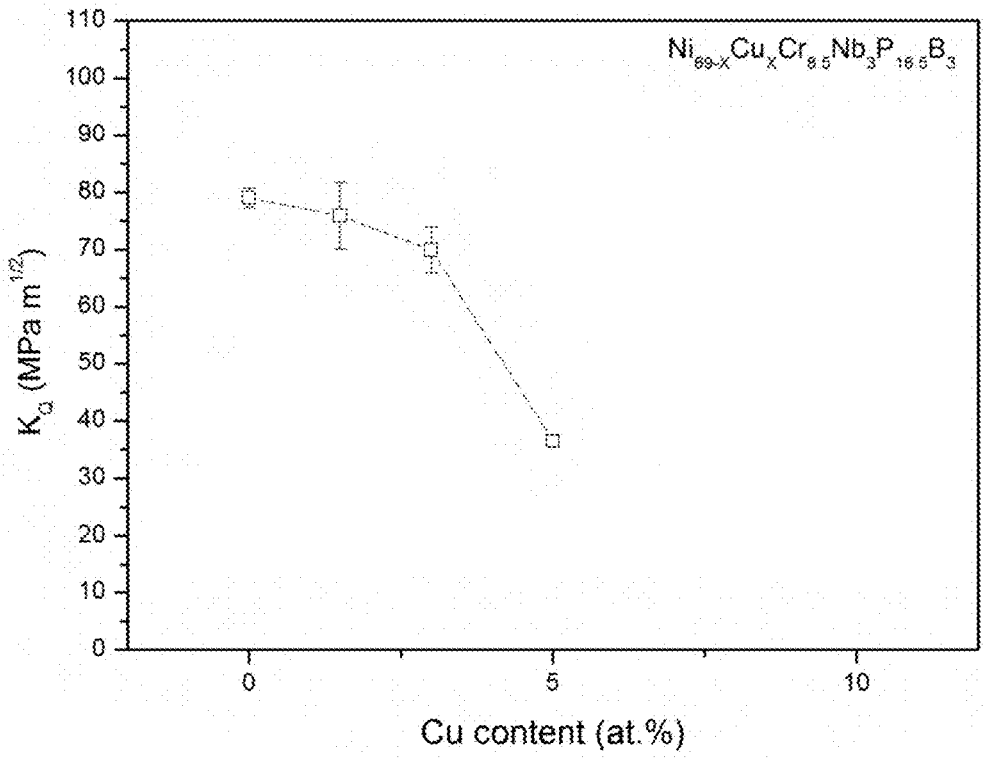
FIG. 24 provides a data plot showing the effect of varying the Ni and Cu atomic concentrations on the notch toughness of $Ni_{69-x}Cu_xCr_{8.5}Nb_3P_{16.5}B_3$ metallic glasses for $0 \le x \le 5$.

FIG. 23 provides a data plot showing the effect of varying the Ni and Cu atomic percent on the glass forming ability of alloys according to the composition formula $Ni_{69-x}Cu_xCr_{8.5}Nb_3P_{16.5}B_3$. FIG. 24 provides a data plot showing the effect of varying the Ni and Cu atomic percent on the notch toughness of metallic glasses according to the composition formula $Ni_{69-x}Cu_xCr_{8.5}Nb_3P_{16.5}B_3$. As shown in Table 11 and FIG. 24, alloys that satisfy the disclosed compositional range given by Eq. (4) demonstrate a critical rod diameter of at least 1 mm, and as high as 9 mm. Also, as shown in Table 11 and FIG. 24, alloys that satisfy the disclosed compositional range given by Eq. (4) demonstrate a notch of at least 36.5 MPa m$^{1/2}$, and as high as 77 MPa m$^{1/2}$. Specifically, in Table 11, Sample alloy 2 composition $Ni_{67.5}Cu_{1.5}Cr_{8.5}Nb_3P_{16.5}B_3$ and sample alloy 3 composition $Ni_{66}Cu_3Cr_{8.5}Nb_3P_{16.5}B_3$ demonstrate a critical rod diameter of at least 8 mm and a notch toughness of at least 70 MPa m$^{1/2}$.

Therefore, in some embodiments, Ni—Cu—Cr—Nb—P—B alloys according to the disclosure where the atomic percent a ranges from 0.5 to 3, b ranges from 7 to 11, c ranges from 2.5 to 3.5, d ranges from 16 to 17, and e ranges from 2.5 to 3.5 demonstrate a critical rod diameter of at least 8 mm, and the notch toughness of the metallic glass is at least 70 MPa m$^{1/2}$.

Specific embodiments of metallic glasses formed from alloys with compositions according to the formula $Ni_{71.4-x}Cu_xCr_{5.52}Nb_{3.38}P_{16.67}B_{3.03}$ are presented in Table 12. The critical rod diameters of sample alloys, along with the notch toughness of corresponding metallic glasses, are also listed in Table 12. In Table 12, Sample 6 with composition $Ni_{71.4}Cr_{5.52}Nb_{3.38}P_{16.67}B_{3.03}$ is free of Cu and is disclosed in U.S. Patent Application No. 61/720,015, exhibiting a critical rod diameter of 11 mm and a notch toughness of 94 MPa m$^{1/2}$.

TABLE 12

Sample alloys demonstrating the effect of increasing the Cu atomic concentration at the expense of Ni on the glass forming ability and notch toughness of the $Ni_{71.4}Cr_{5.52}Nb_{3.38}P_{16.67}B_{3.03}$ alloy and metallic glass, respectively.

| Sample | Composition | Critical Rod Diameter [mm] | Notch Toughness $K_Q$ (MPa m$^{1/2}$) |
|---|---|---|---|
| 6 | $Ni_{71.4}Cr_{5.52}Nb_{3.38}P_{16.67}B_{3.03}$ | 11 | 93.9 ± 2.0 |
| 7 | $Ni_{69.9}Cu_{1.5}Cr_{5.52}Nb_{3.38}P_{16.67}B_{3.03}$ | 9 | 87.1 ± 1.3 |
| 8 | $Ni_{68.4}Cu_3Cr_{5.52}Nb_{3.38}P_{16.67}B_{3.03}$ | 8 | 34.8 ± 1.0 |
| 9 | $Ni_{66.4}Cu_5Cr_{5.52}Nb_{3.38}P_{16.67}B_{3.03}$ | 7 | 47.1 ± 0.6 |
| 10 | $Ni_{61.4}Cu_{10}Cr_{5.52}Nb_{3.38}P_{16.67}B_{3.03}$ | 1 | — |

Figure 25:
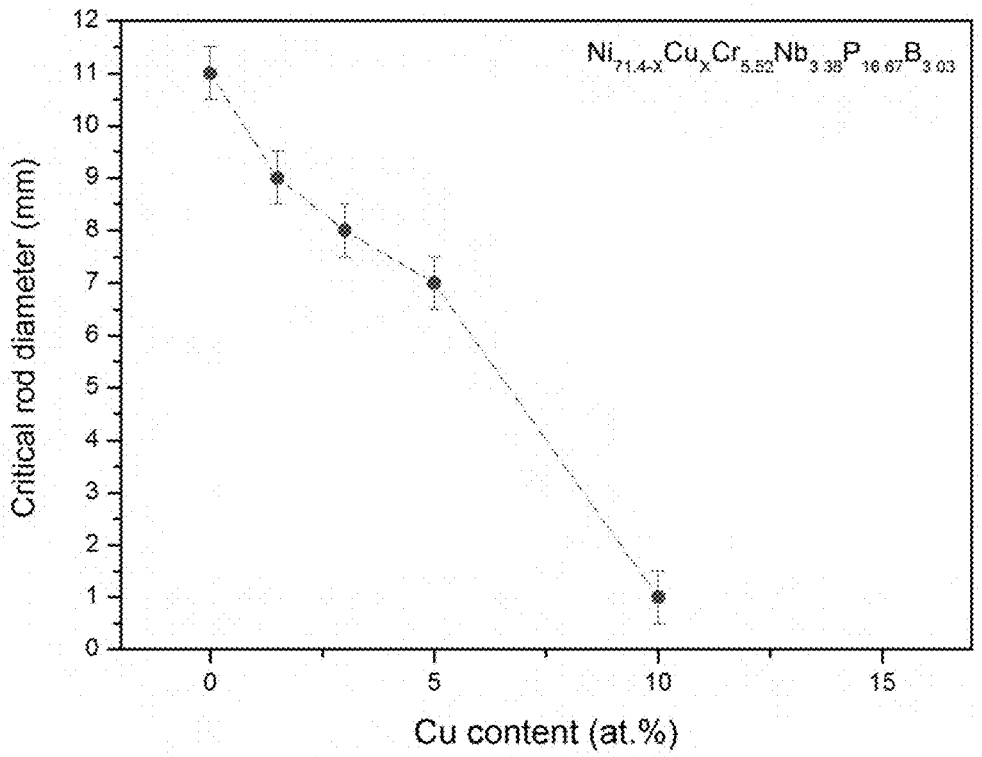
FIG. 25 provides a data plot showing the effect of varying the Ni and Cu atomic percent on the glass forming ability of $Ni_{71.4-x}Cu_xCr_{5.52}Nb_{3.38}P_{16.67}B_{3.03}$ alloys for $0 \le x \le 10$.
Figure 26:
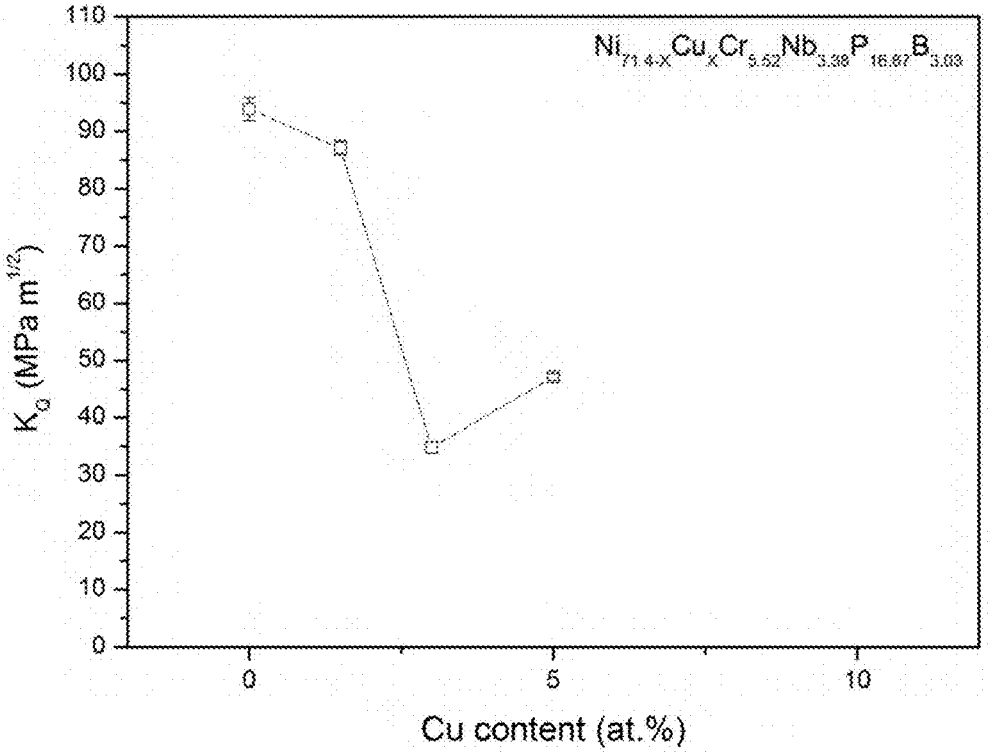
FIG. 26 provides a data plot showing the effect of varying the Ni and Cu atomic concentrations on the notch toughness of $Ni_{71.4-x}Cu_xCr5.52Nb_{3.38}P_{16.67}B_{3.03}$ metallic glasses for $0 \le x \le 5$.

FIG. 25 provides a data plot showing the effect of varying the Ni and Cu atomic percent on the glass forming ability of alloys according to the composition formula $Ni_{71.4-x}Cu_xCr_{5.52}Nb_{3.38}P_{16.67}B_{3.03}$. FIG. 26 provides a data plot showing the effect of varying the Ni and Cu atomic percent on the notch toughness of metallic glasses according to the composition formula $Ni_{71.4-x}Cu_xCr_{5.52}Nb_{3.38}P_{16.67}B_{3.03}$. As shown in Table 12 and FIG. 25, alloys that satisfy the disclosed compositional range given by Eq. (4) demonstrate a critical rod diameter of at least 1 mm, and as high as 9 mm. Also, as shown in Table 12 and FIG. 26, alloys that satisfy the disclosed compositional range given by Eq. (4) demonstrate a notch of at least 47 MPa $m^{1/2}$, and as high as 87 MPa $m^{1/2}$. Specifically, Sample alloys 7-9, compositions $Ni_{69.9}Cu_{1.5}Cr_{5.52}Nb_{3.38}P_{16.67}B_{3.03}$, $Ni_{68.4}Cu_3Cr_{5.52}Nb_{3.38}P_{16.67}B_{3.03}$, and $Ni_{66.4}Cu_5Cr_{5.52}N_{3.38}P_{16.67}B_{3.03}$, demonstrate a critical rod diameter of at least 7 mm and a notch toughness of at least 47 MPa $m^{1/2}$.

Therefore, in some embodiments, Ni—Cu—Cr—Nb—P—B alloys according to the disclosure where the atomic percent a ranges from 0.5 to 5, b ranges from 4 to 7, c ranges from 2.5 to 3.5, d ranges from 16 to 17, and e ranges from 2.5 to 3.5 demonstrate a critical rod diameter of at least 7 mm, and the notch toughness of the metallic glass is at least 45 MPa $m^{1/2}$.

In other embodiments, Ni—Cu—Cr—Nb—P—B metallic glasses according to Eq. (4) of the disclosure exhibit a difference between the crystallization temperature $T_x$ and the glass transition temperature $T_g$, $\Delta T_x=T_x-T_g$, measured at heating rate of 20 K/min, that is unexpectedly higher than the corresponding Fe-free metallic glasses.

Figure 27:
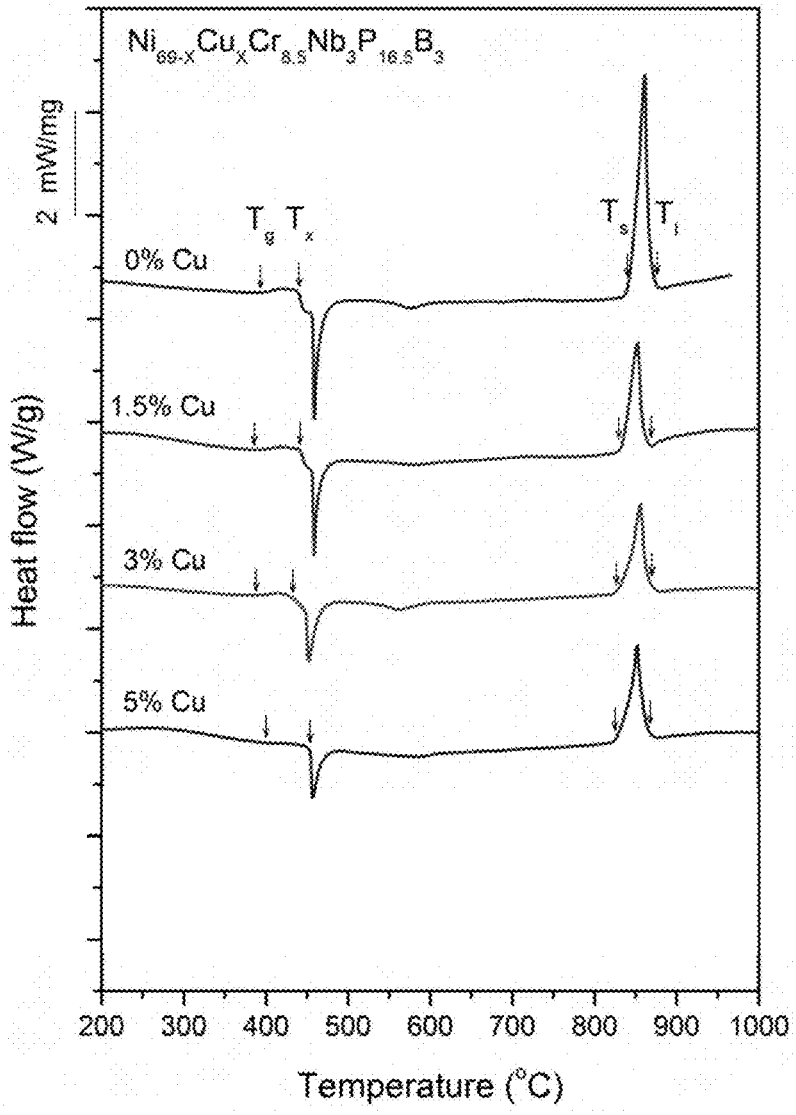
FIG. 27 provides calorimetry scans for sample metallic glasses $Ni_{69-x}Cu_xCr_{8.5}Nb_3P_{16.5}B_3$ in accordance with embodiments of the disclosure. The glass transition temperature $T_g$, crystallization temperature $T_x$, solidus temperature $T_s$, and liquidus temperature $T_l$ are indicated by arrows.
Figure 28:
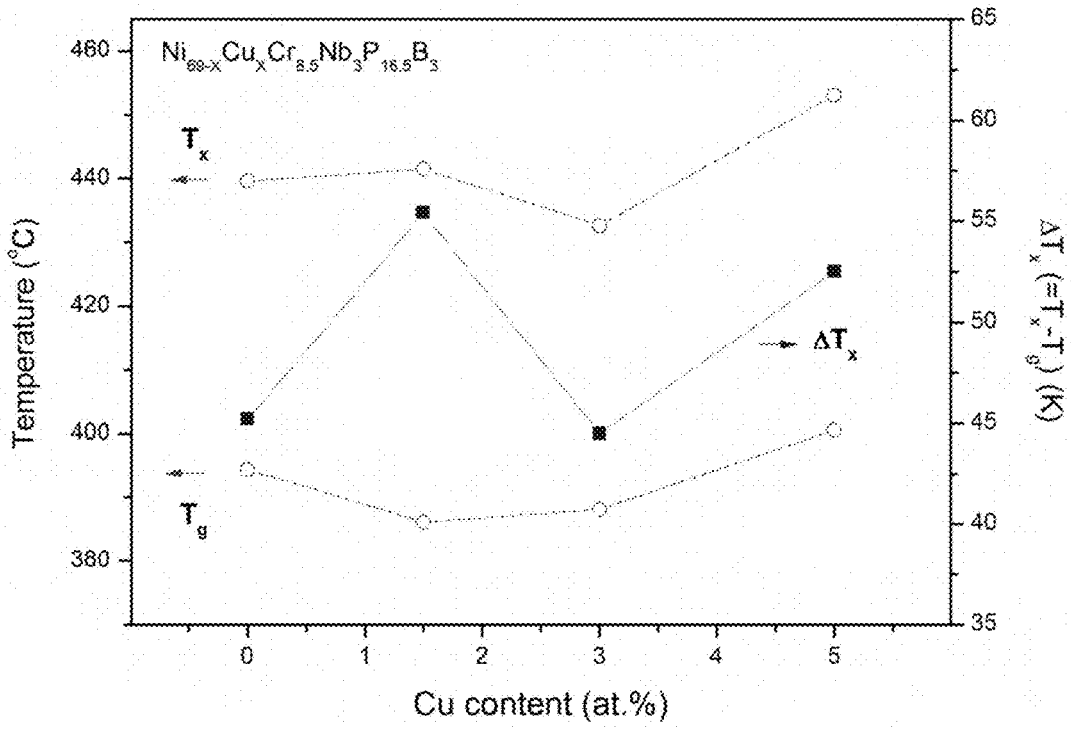
FIG. 28 provides a data plot showing the effect of varying the Ni and Cu atomic percent on the glass transition temperature $T_g$, crystallization temperature $T_x$, and difference $\Delta T_x = T_x - T_g$ of $Ni_{69-x}Cu_xCr_{8.5}Nb_3P_{16.5}B_3$ metallic glasses for $0 \leq x \leq 5$.

FIG. 27 provides calorimetry scans for sample metallic glasses $Ni_{69-x}Cu_xCr_{8.5}Nb_3P_{16.5}B_3$ in accordance with embodiments of the disclosure. The glass transition temperature $T_g$, crystallization temperature $T_x$, solidus temperature $T_s$, and liquidus temperature, $T_l$ are indicated by arrows in FIG. 27. Table 13 lists the glass transition temperature $T_g$, crystallization temperature $T_x$, solidus temperature $T_s$, and liquidus temperature $T_l$ along with the respective $\Delta T_x$ value for sample metallic glasses $Ni_{69-x}Cu_xCr_{8.5}Nb_3P_{16.5}B_3$ in accordance with embodiments of the disclosure. FIG. 28 provides a data plot showing the effect of varying the Ni and Cu atomic percent on the glass transition temperature $T_g$, crystallization temperature $T_x$, and difference $\Delta T_x=T_x-T_g$ of $Ni_{69-x}Cu_xCr_{8.5}Nb_3P_{16.5}B_3$ metallic glasses for $0.5 \le x \le 5$.

TABLE 13

Effect of increasing the Cu atomic concentration at the expense of Ni on the glass-transition temperature $T_g$, crystallization temperature $T_x$, $\Delta T_x = T_x - T_g$, solidus temperature $T_s$, and liquidus temperature $T_l$ of the $Ni_{69}Cr_{8.5}Nb_3P_{16.5}B_3$ alloy and metallic glass.

| Sample | Composition | $T_g$ (° C.) | $T_x$ (° C.) | $\Delta T_x$ (° C.) | $T_s$ (° C.) | $T_l$ (° C.) |
|---|---|---|---|---|---|---|
| 1 | $Ni_{69}Cr_{8.5}Nb_3P_{16.5}B_3$ | 394.4 | 439.6 | 45.2 | 841.7 | 867.4 |
| 2 | $Ni_{67.5}Cu_{1.5}Cr_{8.5}Nb_3P_{16.5}B_3$ | 386.1 | 441.5 | 55.4 | 829.9 | 868.4 |
| 3 | $Ni_{66}Cu_3Cr_{8.5}Nb_3P_{16.5}B_3$ | 388.1 | 432.6 | 44.5 | 826.5 | 869.8 |
| 4 | $Ni_{64}Cu_5Cr_{8.5}Nb_3P_{16.5}B_3$ | 400.6 | 453.1 | 52.5 | 824.8 | 868.1 |

As shown in FIGS. 27 and 28, and Table 13, $\Delta T_x$ values are unexpectedly larger when the Cu atomic percent is between 0.5 and 5 compared to the value of the Cu-free alloy. Specifically, the $\Delta T_x$ value for the Cu-free metallic glass $Ni_{69}Cr_{8.5}Nb_3P_{16.5}B_3$ is 45.2° C. The $\Delta T_x$ values for the $Ni_{67.5}Cu_{1.5}Cr_{8.5}Nb_3P_{16.5}B_3$ metallic glass is 55.4° C. and for the $Ni_{64}Cu_5Cr_{8.5}Nb_3P_{16.5}B_3$ metallic glass is 52.5° C.

Therefore, in some embodiments, Ni—Cu—Cr—Nb—P—B metallic glasses according to Eq. (4) of the disclosure where the atomic percent a ranges from 0.5 to 5, b ranges from 5 to 12, c ranges from 2 to 4, d ranges from 15.5 to 17.5, and e ranges from 2 to 4 exhibit a difference between the crystallization temperature $T_x$ and the glass transition temperature $T_g$, $\Delta T_x=T_x-T_g$, measured at heating rate of 20 K/min, of at least 46° C. In other embodiments, Ni—Cu—Cr—Nb—P—B metallic glasses according to Eq. (4) of the disclosure where the atomic percent a ranges from 0.5 to 3, b ranges from 7.5 to 9.5, c ranges from 2.5 to 3.5, d ranges from 16 to 17, and e ranges from 2.5 to 3.5 exhibit a difference between the crystallization temperature $T_x$ and the glass transition temperature $T_g$, $\Delta T_x=T_x-T_g$, measured at heating rate of 20 K/min, of at least 50° C. (samples 3-5).

Figure 29:
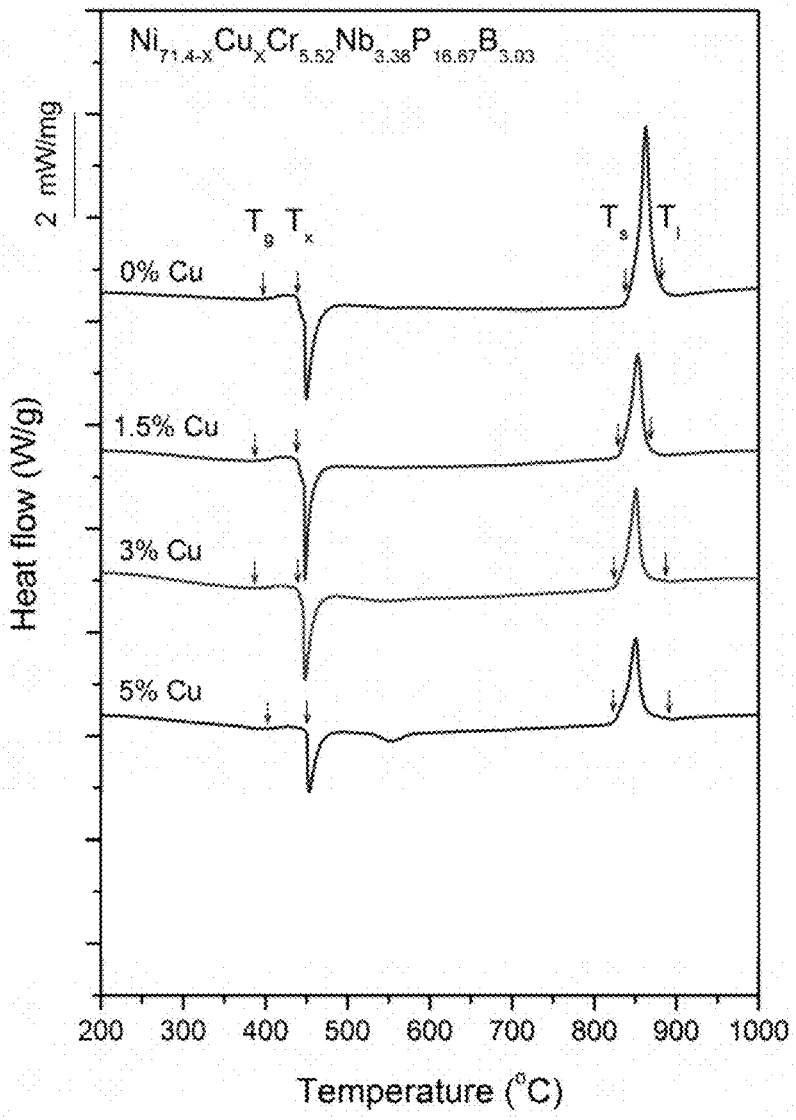
FIG. 29 provides calorimetry scans for sample metallic glasses $Ni_{71.4-x}Cu_xCr_{5.52}Nb_{3.38}P_{16.67}B_{3.03}$ in accordance with embodiments of the disclosure. The glass transition temperature $T_g$, crystallization temperature $T_x$, solidus temperature $T_s$, and liquidus temperature $T_l$ are indicated by arrows.
Figure 30:
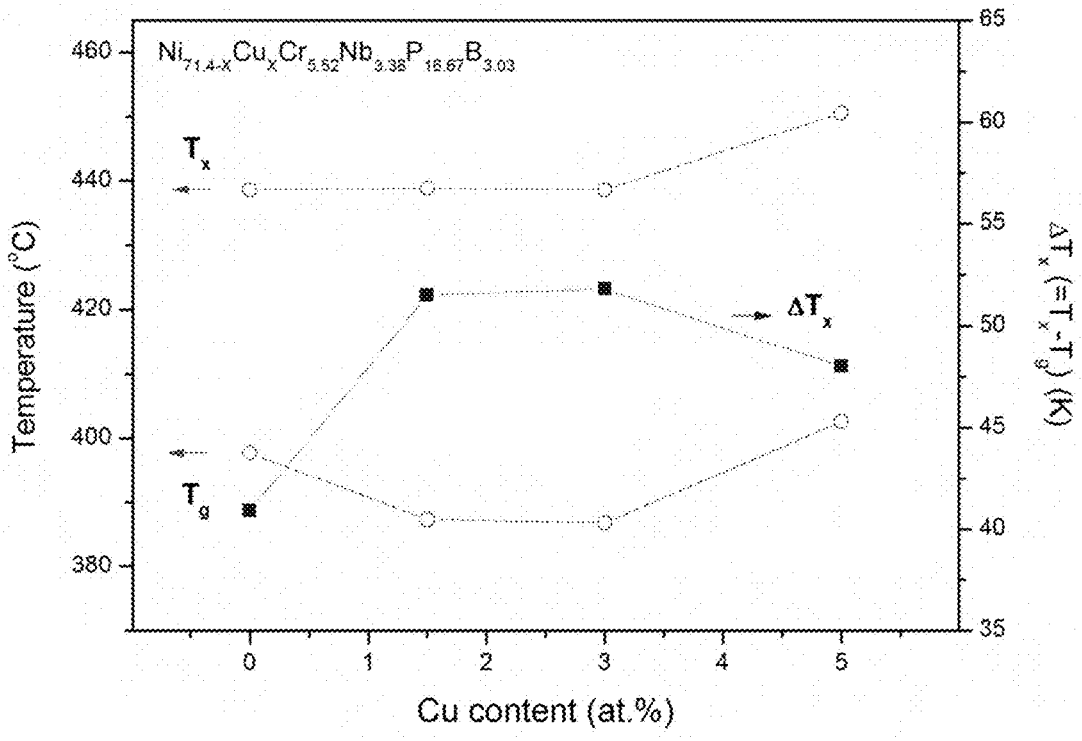
FIG. 30 provides a data plot showing the effect of varying the Ni and Cu atomic percent on the glass transition temperature $T_g$, crystallization temperature $T_x$, and difference $\Delta T_x = T_x - T_g$ of $Ni_{71.4-x}Cu_xCr_{5.52}Nb_{3.38}P_{16.67}B_{3.03}$ metallic glasses for $0 \leq x \leq 5$.

FIG. 29 provides calorimetry scans for sample metallic glasses $Ni_{71.4-x}Cu_xCr_{5.52}Nb_{3.38}P_{16.67}B_{3.03}$ in accordance with embodiments of the disclosure. The glass transition temperature $T_g$, crystallization temperature $T_x$, solidus temperature $T_s$, and liquidus temperature, $T_l$ are indicated by arrows in FIG. 29. Table 14 lists the glass transition temperature $T_g$, crystallization temperature $T_x$, solidus temperature $T_s$, and liquidus temperature $T_l$ along with the respective $\Delta T_x$ value for sample metallic glasses $Ni_{71.4-x}Cu_xCr_{5.52}Nb_{3.38}P_{16.67}B_{3.03}$ in accordance with embodiments of the disclosure. FIG.30 provides a data plot showing the effect of varying the Ni and Cu atomic percent on the glass transition temperature $T_g$, crystallization temperature $T_x$, and difference $\Delta T_x=T_x-T_g$ of $Ni_{71.4-x}Cu_xCr_{5.52}Nb_{3.38}P_{16.67}B_{3.03}$ metallic glasses for $0.5 \le x \le 5$.

TABLE 14

Effect of increasing the Cu atomic concentration at the expense of Ni on the glass-transition temperature $T_g$, crystallization temperature $T_x$, $\Delta T_x = T_x - T_g$, solidus temperature $T_s$, and liquidus temperature $T_l$ of the $Ni_{71.4}Cr_{5.52}Nb_{3.38}P_{16.67}B_{3.03}$ alloy and metallic glass.

| Example | Composition | $T_g$ (° C.) | $T_x$ (° C.) | $\Delta T_x$ (° C.) | $T_s$ (° C.) | $T_l$ (° C.) |
|---|---|---|---|---|---|---|
| 6 | $Ni_{71.4}Cr_{5.52}Nb_{3.38}P_{16.67}B_{3.03}$ | 397.7 | 438.6 | 40.9 | 841.8 | 872.7 |
| 7 | $Ni_{69.9}Cu_{1.5}Cr_{5.52}Nb_{3.38}P_{16.67}B_{3.03}$ | 387.3 | 438.8 | 51.5 | 829.2 | 868.9 |
| 8 | $Ni_{68.4}Cu_3Cr_{5.52}Nb_{3.38}P_{16.67}B_{3.03}$ | 386.8 | 438.6 | 51.8 | 824.0 | 886.9 |
| 9 | $Ni_{66.4}Cu_5Cr_{5.52}Nb_{3.38}P_{16.67}B_{3.03}$ | 402.6 | 450.6 | 48.0 | 823.0 | 890.6 |

As shown in FIGS. 29 and 30, and Table 14, $\Delta T_x$ values are unexpectedly larger when the Cu atomic percent is between 0.5 and 5 compared to the value of the Cu-free alloy.

Specifically, the $\Delta T_x$ value for the Cu-free metallic glass $Ni_{71.4}Cr_{5.52}Nb_{3.38}P_{16.67}B_{3.03}$ is 40.9° C. The $\Delta T_x$ values for $Ni_{69-x}Fe_xCr_{8.5}Nb_3P_{16.5}B_3$ metallic glasses for $0.5 \leq x \leq 5$ are all larger than 41 ° C., and particularly the value for the metallic glass $Ni_{68.4}Cu_3Cr_{5.52}Nb_{3.38}P_{16.67}B_{3.03}$ is 51.8° C.

Therefore, in some embodiments, Ni—Cu—Cr—Nb—P—B metallic glasses according to Eq. (4) of the disclosure where the atomic percent a ranges from 0.5 to 5, b ranges from 3 to 13, c is determined by $x-y \cdot b$, where x ranges from 3.8 to 4.2 and y ranges from 0.11 to 0.14, d ranges from 15.5 to 17.5, e ranges from 2 to 4, and wherein the difference between the crystallization temperature $T_x$ and the glass transition temperature $T_g$, $\Delta T_x = T_x - T_g$, measured at heating rate of 20 K/min, is at least 41° C. (Samples 7-9). In other embodiments, Ni—Cu—Cr—Nb—P—B metallic glasses according to Eq. (4) of the disclosure where the atomic percent a ranges from 0.5 to 3, b ranges from 4 to 7, c ranges from 3.5 to 3.5, d ranges from 16 to 17, e ranges from 2.5 to 3.5, and wherein the difference between the crystallization temperature $T_x$ and the glass transition temperature $T_g$, $\Delta T_x = T_x - T_g$, measured at heating rate of 20 K/min, is at least 50° C. (samples 7-8).

Description of Methods of Processing the Sample Alloys

A method for producing the alloy ingots involves inductive melting of the appropriate amounts of elemental constituents in a quartz tube under inert atmosphere. The purity levels of the constituent elements were as follows: Ni 99.995%, Fe 99.95%, Co 99.995%, Cu 99.995%, Cr 99.996%, Nb 99.95%, P 99.9999%, and B 99.5%.

A particular method for producing metallic glass rods from the alloy ingots for the sample alloys involves re-melting the alloy ingots in quartz tubes having 0.5-mm thick walls in a furnace at 1100° C. or higher, and in some embodiments, ranging from 1150° C. to 1400° C., under high purity argon and rapidly quenching in a room-temperature water bath. Alternatively, the bath could be ice water or oil. The melting crucible may alternatively be a ceramic such as alumina or zirconia, graphite, sintered crystalline silica, or a water-cooled hearth made of copper or silver. Metallic glass articles can be alternatively formed by injecting or pouring the molten alloy into a metal mold. The mold can be made of copper, brass, or steel, among other materials.

Optionally, prior to producing an metallic glass article, the alloyed ingots may be fluxed with a reducing agent by re-melting the ingots in a quartz tube under inert atmosphere, bringing the alloy melt in contact with the molten reducing agent, and allowing the two melts to interact for about 1000 s at a temperature of about 1200° C. or higher under inert atmosphere, and subsequently water quenching. In some embodiments, the reducing agent comprises boron and oxygen. In one embodiment, the reducing agent is boron oxide.

Test Methodology For Assessing Glass-Forming Ability

The glass-forming ability of each alloy was assessed by determining the maximum rod diameter in which the amorphous phase of the alloy (i.e. the metallic glass phase) could be formed when processed by the method described above, namely water quenching a quartz tube having 0.5 mm thick walls containing the molten alloy. The melt temperature of the Fe and Co bearing alloys prior to quenching was 1350° C., while that of the Cu-bearing alloys was 1250° C. X-ray diffraction with Cu-Kα radiation was performed to verify the amorphous structure of the alloys.

Test Methodology For Differential Scanning Calorimetry

Differential scanning calorimetry was performed on sample metallic glasses at a scan rate of 20 K/min to determine the glass-transition, crystallization, solidus, and liquidus temperatures of sample metallic glasses.

Test Methodology For Measuring Notch Toughness

The notch toughness of sample metallic glasses was performed on 3-mm diameter metallic glass rods. The rods were produced by the method of quenching a quartz tube having 0.5 mm thick walls containing the molten alloy. The melt temperature of the Fe and Co bearing alloys prior to quenching was 1350° C., while that of the Cu-bearing alloys was 1250° C. The rods were notched using a wire saw with a root radius ranging from 0.10 to 0.13 mm to a depth of approximately half the rod diameter. The notched specimens were tested on a 3-point beam configuration with span of 12.7 mm, and with the notched side carefully aligned and facing the opposite side of the center loading point. The critical fracture load was measured by applying a monotonically increasing load at constant cross-head speed of 0.001 mm/s using a screw-driven testing frame. At least three tests were performed, and the variance between tests is included in the notch toughness plots. The stress intensity factor for the geometrical configuration employed here was evaluated using the analysis by Murakimi (Y. Murakami, Stress Intensity Factors Handbook, Vol. 2, Oxford: Pergamon Press, p. 666 (1987)).

Test Methodology For Measuring Hardness

The Vickers hardness (HV0.5) of sample metallic glasses was measured using a Vickers microhardness tester. Eight tests were performed where micro-indentions were inserted on a flat and polished cross section of a 3 mm metallic glass rod using a load of 500 g and a duel time of 10 s.

Test Methodology For Measuring Compressive Yield Strength

Compression testing of exemplary metallic glasses was performed on cylindrical specimens 3 mm in diameter and 6 mm in length by applying a monotonically increasing load at constant cross-head speed of 0.001 mm/s using a screw-driven testing frame. The strain was measured using a linear variable differential transformer. The compressive yield strength was estimated using the 0.2% proof stress criterion.

Test Methodology For Measuring Density and Moduli

The shear and longitudinal wave speeds of were measured ultrasonically using a pulse-echo overlap set-up with 25 MHz piezoelectric transducers on a cylindrical metallic glass specimen 5 mm in diameter and about 11 mm in length produced by water quenching a quartz tube having 0.5 mm thick walls containing a molten alloy at 1150° C. The density was measured by the Archimedes method, as given in the American Society for Testing and Materials standard C693-93. Using the density and elastic constant values, the shear modulus, bulk modulus, Young's modulus, and Poisson's ratio were estimated using Hooke's law identities.

Test Methodology For Measuring Corrosion Resistance

The corrosion resistance of sample metallic glasses was evaluated by immersion tests in hydrochloric acid (HCl). A rod of metallic glass sample with initial diameter of 3.13 mm, and a length of 21.96 mm was immersed in a bath of 6M HCl at room temperature. The corrosion depth at various stages during the immersion was estimated by measuring the mass change with an accuracy of ±0.01 mg. The corrosion rate was estimated assuming linear kinetics.

The disclosed Ni—Fe—Cr—Nb—P—B alloys and metallic glasses with controlled ranges within the disclosed composition range demonstrate a combination of good glass forming ability, high toughness, and large $\Delta T_x$ values. The disclosed alloys are capable of forming metallic glasses having critical rod diameters of at least 1 mm and in some instances up to at least 9 mm when processed by the particular method described herein. Certain alloys with very good glass forming ability also have high notch toughness exceeding 90 MPa $m^{1/2}$, and $\Delta T_x$ values exceeding 60° C. The combination of good glass-forming ability, high toughness, and large $\Delta T_x$ values makes the present Ni—Fe—Cr—Nb—P—B alloys and metallic glasses excellent candidates for various engineering applications. Among many applications, the disclosed alloys may be used in consumer electronics, dental and medical implants and instruments, luxury goods, and sporting goods applications.

The disclosed Ni—Co—Cr—Nb—P—B alloys and metallic glasses with controlled ranges within the disclosed composition range demonstrate a combination of good glass forming ability, high toughness, and large $\Delta T_x$ values. The disclosed alloys are capable of forming metallic glasses having critical rod diameters of at least 3 mm and in some instance up to 11 mm when processed by the particular method described herein. Certain alloys with very good glass forming ability also have high notch toughness exceeding 100 MPa $m^{1/2}$, and $\Delta T_x$ values exceeding 55° C. The combination of good glass-forming ability, high toughness, and large $\Delta T_x$ values makes the present Ni—Co—Cr—Nb—P—B alloys and metallic glasses excellent candidates for various engineering applications. Among many applications, the disclosed alloys may be used in consumer electronics, dental and medical implants and instruments, luxury goods, and sporting goods applications.

The disclosed Ni—Cu—Cr—Nb—P—B alloys and metallic glasses with controlled ranges within the disclosed composition range demonstrate a combination of good glass forming ability, high toughness, and large $\Delta T_x$ values. The disclosed alloys are capable of forming metallic glass rods of diameters at least 1 mm and in some instances at least 9 mm when processed by the particular method described herein. Certain alloys with very good glass forming ability also have high notch toughness that in some embodiments exceeds 85 MPa $m^{1/2}$, and high $\Delta T_x$ values that in some embodiments exceed 55° C. The combination of good glass-forming ability, high toughness, and large $\Delta T_x$ values makes the present Ni—Cu—Cr—Nb—P—B alloys and metallic glasses excellent candidates for various engineering applications. Among many applications, the disclosed alloys may be used in consumer electronics, dental and medical implants and instruments, luxury goods, and sporting goods applications.

The alloys and metallic glasses described herein can be valuable in the fabrication of electronic devices. An electronic device herein can refer to any electronic device known in the art. For example, it can be a telephone, such as a mobile phone, and a land-line phone, or any communication device, such as a smart phone, including, for example an iPhone®, and an electronic email sending/receiving device. It can be a part of a display, such as a digital display, a TV monitor, an electronic-book reader, a portable web-browser (e.g., iPad®), and a computer monitor. It can also be an entertainment device, including a portable DVD player, conventional DVD player, Blue-Ray disk player, video game console, music player, such as a portable music player (e.g., iPod®), etc. It can also be a part of a device that provides control, such as controlling the streaming of images, videos, sounds (e.g., Apple TV®), or it can be a remote control for an electronic device. It can be a part of a computer or its accessories, such as the hard drive tower housing or casing, laptop housing, laptop keyboard, laptop track pad, desktop keyboard, mouse, and speaker. The article can also be applied to a device such as a watch or a clock.

Having described several embodiments, it will be recognized by those skilled in the art that various modifications, alternative constructions, and equivalents may be used without departing from the spirit of the disclosure. Those skilled in the art will appreciate that the presently disclosed embodiments teach by way of example and not by limitation. Therefore, the matter contained in the above description or shown in the accompanying drawings should be interpreted as illustrative and not in a limiting sense. Additionally, a number of well-known processes and elements have not been described in order to avoid unnecessarily obscuring the disclosure.

The following claims are intended to cover all generic and specific features described herein, as well as all statements of the scope of the present method and system, which, as a matter of language, might be said to fall therebetween

What is claimed is:

1. An alloy capable of forming a metallic glass, the alloy represented by the following formula (subscripts denote atomic percent):

$$Ni_{(100-a-b-c-d-e)}Fe_aCr_bNb_cP_dB_e, \text{ wherein}$$

a is greater than 2 and up to 15, b ranges from 2 to 15, c ranges from 1 to 5, d ranges from 14 to 19, and e ranges from 1 to 5;

wherein the alloy has a critical rod diameter of at least 1 mm, wherein $\Delta T_x$ of the metallic glass formed from the alloy is at least 3° C. higher compared to $\Delta T_x$ of the metallic glass formed from a substantially identical alloy free of Fe and containing a corresponding increased amount of Ni.

2. The alloy of claim 1, wherein a is greater than 2 and up to 12.5, b ranges from 5 to 12, c ranges from 2 to 4, d ranges from 16.25 to 17, e ranges from 2.75 to 3.5, and wherein the alloy has a critical rod diameter of at least 2 mm.

3. The alloy of claim 1, wherein a is greater than 2 and up to 12.5, b ranges from 3 to 13, c is determined by x−y·b, where x ranges from 3.8 to 4.2 and y ranges from 0.11 to 0.14, d ranges from 16.25 to 17, e ranges from 2.75 to 3.5, and wherein the alloy has a critical rod diameter of at least 3 mm.

4. The alloy of claim 1, wherein a is greater than 2 and up to 12.5, b ranges from 3 to 13, c is determined by x−y·b, where x ranges from 3.8 to 4.2 and y ranges from 0.11 to 0.14, d ranges from 15.5 to 17.5, e ranges from 2 to 4, and wherein the metallic glass has $\Delta T_x$ of at least 41° C.

5. The alloy of claim 1, wherein a is greater than 2 and up to 10, b ranges from 4 to 7, c ranges from 2.5 to 3.5, d ranges from 16 to 17, e ranges from 2.5 to 3.5, and wherein the metallic glass has $\Delta T_x$ of at least 50° C.

6. A metallic glass comprising an alloy according to claim 1.

7. An alloy capable of forming a metallic glass, the alloy represented by the following formula (subscripts denote atomic percent):

$Ni_{(100-a-b-c-d-e)}Co_aCr_bNb_cP_dB_e$, wherein a is greater than 2 and up to 25, b ranges from 2 to 15, c ranges from 1 to 5, d ranges from 14 to 19, e ranges from 1 to 5;

wherein the alloy has a critical rod diameter of at least 3 mm, wherein $\Delta T_x$ of the metallic glass formed from the alloy is at least 3° C. higher compared to $\Delta T_x$ of the metallic glass formed from a substantially identical alloy free of Co and containing a corresponding increased amount of Ni.

8. The alloy of claim 7, wherein a is greater than 2 and up to 20, b ranges from 5 to 12, c ranges from 2 to 4, d ranges from 16.25 to 17, e ranges from 2.75 to 3.5, wherein the alloy has a critical rod diameter of at least 6 mm.

9. The alloy of claim 7, wherein a is greater than 2 and up to 20, b ranges from 3 to 13, c is determined by x−y·b, where x ranges from 3.8 to 4.2 and y ranges from 0.11 to 0.14, d ranges from 16.25 to 17, e ranges from 2.75 to 3.5, wherein the alloy has a critical rod diameter of at least 6 mm.

10. The alloy of claim 7, wherein a is greater than 2 and up to 15, b ranges from 7.5 to 11, c ranges from 2.75 to 3.25, d ranges from 16.25 to 16.75, e ranges from 2.75 to 3.25, and wherein the alloy has a critical rod diameter of at least 8 mm.

11. The alloy of claim 7, wherein a is greater than 2 and up to 15, b ranges from 4 to 7.5, c ranges from 3.25 to 3.75, d ranges from 16.25 to 16.75, e ranges from 2.75 to 3.5, wherein the alloy has a critical rod diameter of at least 8 mm.

12. The alloy of claim 7, wherein a is greater than 2 and up to 5, b ranges from 8 to 9.5, c ranges from 2.75 to 3.25, d ranges from 16.25 to 16.75, e ranges from 2.75 to 3.25, and wherein the alloy has a critical rod diameter of at least 9 mm, and wherein the metallic glass has notch toughness of at least 70 MPa $m^{1/2}$.

13. The alloy of claim 7, wherein a is greater than 2 and up to 5, b ranges from 5 to 6, c ranges from 3.25 to 3.75, d ranges from 16.25 to 16.75, e ranges from 2.75 to 3.25, and wherein the alloy has a critical rod diameter of at least 9 mm, and wherein the metallic glass has notch toughness of at least 80 MPa $m^{1/2}$.

14. The alloy of claim 7, wherein a is greater than 2 and up to 25, b ranges from 8 to 9.5, c ranges from 2.75 to 3.25, d ranges from 16.25 to 16.75, e ranges from 2.75 to 3.25, and wherein the metallic glass has $\Delta T_x$ of at least 46° C.

15. The alloy of claim 7, wherein a is greater than 2 and up to 25, b ranges from 5 to 6, c ranges from 3.25 to 3.75, d ranges from 16.25 to 16.75, e ranges from 2.75 to 3.25, and wherein the metallic glass has $\Delta T_x$ of at least 41° C.

16. A metallic glass comprising an alloy according to claim 7.

* * * * *